US010143254B2

(12) United States Patent
Hawes et al.

(10) Patent No.: US 10,143,254 B2
(45) Date of Patent: Dec. 4, 2018

(54) HEADWEAR WITH PASS-THROUGH SLOTS

(71) Applicant: Under Armour, Inc., Baltimore, MD (US)

(72) Inventors: Eric Hawes, Baltimore, MD (US); Whitney Enck, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 0 days.

(21) Appl. No.: 15/153,801

(22) Filed: May 13, 2016

(65) Prior Publication Data

US 2016/0331057 A1 Nov. 17, 2016

Related U.S. Application Data

(60) Provisional application No. 62/160,756, filed on May 13, 2015.

(51) Int. Cl.

| | |
|---|---|
| ***A42B 1/20*** | (2006.01) |
| ***A42B 1/24*** | (2006.01) |
| ***A42B 1/04*** | (2006.01) |
| *A42B 1/00* | (2006.01) |

(52) U.S. Cl.

CPC ..... *A42B 1/245* (2013.01); *A42B 1/041* (2013.01)

(58) Field of Classification Search

CPC .. A42B 1/245; A42B 1/241; H04R 2201/023; H04R 1/105; H04R 1/1066; H04R 1/1075; H04R 5/0335; H04R 1/10; H04B 1/385; H04B 2001/3866

See application file for complete search history.

(56) References Cited

U.S. PATENT DOCUMENTS

| | | | | |
|---|---|---|---|---|
| 1,556,792 A | | 10/1925 | Jones | |
| 3,845,389 A | * | 10/1974 | Phillips | A42B 3/30 2/5 |
| 4,321,433 A | * | 3/1982 | King | A42B 3/30 2/414 |
| 4,451,935 A | * | 6/1984 | Henschel | A42B 1/241 2/181 |

(Continued)

FOREIGN PATENT DOCUMENTS

| | | |
|---|---|---|
| CA | 2395480 A1 | 2/2004 |
| CN | 2884762 Y | 3/2007 |

(Continued)

*Primary Examiner* — Bobby Muromoto, Jr.

(74) *Attorney, Agent, or Firm* — Edell, Shapiro & Finnan, LLC

(57) ABSTRACT

An article of headwear made of a resilient material includes at least two panels that cooperate to form openings or pass-through slots through which a user may thread earbuds or headphones while maintaining coverage of the ear. The ends of the at least two panels may overlap one another. The ends of the panels may be reconfigurable between a first configuration where the panels lay flat over one another and a second configuration, where the panels are manipulated to no longer lay flat over one another to define at least one opening. One of the panels may include a non-resilient material coupled to at least one of the panels proximate to the end of the panel to aid the user in threading earbuds through the at least one opening at least partially defined by the non-resilient material.

19 Claims, 24 Drawing Sheets

(56) References Cited

U.S. PATENT DOCUMENTS 4,776,044 A * 10/1988 Makins ..... A42B 1/245 2/172
4,864,619 A 9/1989 Spates
5,303,426 A 4/1994 Jones
5,329,592 A 7/1994 Altman
5,410,746 A * 4/1995 Gelber ..... A42B 1/245 2/209.13
6,115,843 A 9/2000 Travalgia
6,301,367 B1 10/2001 Boyden et al.
6,305,026 B1 10/2001 Mo
6,671,885 B2 1/2004 Viggiano
8,009,847 B2 * 8/2011 Planansky ..... H04R 5/02 2/422
8,189,844 B2 5/2012 Dolberg
8,316,467 B2 11/2012 Foust et al.
9,143,854 B2 * 9/2015 Alao ..... H04R 1/105
2003/0196249 A1 * 10/2003 Roberts ..... A42B 1/245 2/209.13
2005/0123151 A1 * 6/2005 Whipple ..... H04R 5/023 381/103
2006/0185062 A1 * 8/2006 Peng ..... H04R 5/0335 2/209.13
2007/0003092 A1 * 1/2007 Shen ..... A42B 1/068 381/374
2007/0226876 A1 * 10/2007 Foust ..... A42B 1/245 2/171
2008/0044052 A1 * 2/2008 Whipple ..... A42B 1/245 381/376
2008/0144872 A1 * 6/2008 Phillips ..... H04R 5/0335 381/333
2008/0181429 A1 * 7/2008 Fried ..... A42B 1/245 381/87
2008/0295224 A1 * 12/2008 Mintzer ..... A42B 1/245 2/209.13
2009/0005179 A1 1/2009 Petsalis
2009/0180658 A1 * 7/2009 Dolberg ..... H04R 1/1033 381/376
2009/0208040 A1 * 8/2009 Planansky ..... H04R 5/02 381/301
2011/0000941 A1 * 1/2011 Volk ..... A42B 1/241 224/181
2012/0099755 A1 * 4/2012 Hu ..... H04R 1/1066 381/380
2013/0022226 A1 * 1/2013 Anderson ..... H04R 1/10 381/380
2013/0039524 A1 * 2/2013 Jones ..... H04R 5/033 381/378
2014/0259265 A1 * 9/2014 Schermerhorn ..... A42B 1/12 2/68
2014/0328508 A1 * 11/2014 Jacks ..... H04R 1/1008 381/376

FOREIGN PATENT DOCUMENTS

CN 101611941 A 12/2009
CN 101664233 A 3/2010
DE 202006008395 U1 8/2006
EP 2103862 B1 11/2012
WO WO2010015030 A1 2/2010
WO WO2013028127 A1 2/2013

* cited by examiner

HEADWEAR WITH PASS-THROUGH SLOTS

CROSS-REFERENCE TO RELATED APPLICATIONS

This application claims priority under 35 U.S.C. 119(e) to U.S. Provisional Patent Application Ser. No. 62/160,756, entitled "Headwear with Pass-Through Slots", filed May 13, 2015, the disclosure of which is incorporated herein by reference in its entirety for all purposes.

FIELD OF THE INVENTION

The present invention relates to headwear covering the ears. More specifically, the present invention relates to headwear with openings configured to receive objects therein.

BACKGROUND OF THE INVENTION

During cold weather/temperature activities, headwear is typically utilized to warm the ears, neck and head. During these activities, people often listen to music, podcasts, or make phone calls through the use of earbud headphones connected by wire to a mobile device. During movement or athletic activities, however, earbuds are more likely to shift and slip within the ear, and may even be accidentally pulled from the ear, which can be aggravating, or even dangerous, to the wearer. In addition, it is uncomfortable for people to wear earbuds while also wearing headwear that cover their ears because the earbuds extend outwardly from the ears of the wearer and the headwear presses the earbuds further into the ear of the wearer, which creates an unwanted pressure in the ears of the wearer. The earbuds may also prevent the headwear from resting comfortably against the ears and/or the sides of the head of the wearer, which then allows cold air to enter the interior of the headwear. Thus, it would be desirable to provide an article of headwear having the ability to keep earbuds comfortably in place without the need for frequent adjustment and readjustment that also keeps the head, neck, and ears of a wearer warm.

BRIEF SUMMARY OF THE INVENTION

An article of headwear surrounds at least the substantial circumference of the wearer's head and has a front side and a rear side, a first side, and a second side. In an embodiment, the headwear may include a first fabric panel and a second fabric panel that are joined by stitching proximate to the first and second edges of each of the panels. The stitching joining the first and second panels is positioned at the top and bottom regions of each of the first and second edges such that a portion of the first and second edges of the first panel overlaps a portion of the first and second edges of the second portion. By way of such stitching and the positioning of the edges, the first and second panels cooperate to form an opening, or slot, at the first and second sides of the headwear, while maintaining coverage of the ears. With this configuration, an article of headwear is provided that allows for auditory equipment, i.e., headphones or earbuds, to pass through the openings on the first and second sides of the headwear to securely and comfortably position the earbuds within the ear of the user. This configuration also allows the headwear to rest closely against the sides of the head of the wearer and the ears of the wearer to prevent cold air from entering the interior of the headwear. The described configuration of the headwear allows for a wearer to comfortably secure headphones to their ears while keeping their ears and head warm. The above described features and advantages, as well as others, will become more readily apparent to those of ordinary skill in the art by reference to the following detailed description and accompanying drawings.

BRIEF DESCRIPTION OF THE SEVERAL VIEWS OF THE DRAWINGS

Like reference numerals have been used to identify like elements throughout this disclosure.

DETAILED DESCRIPTION OF THE INVENTION

Figure 1A:
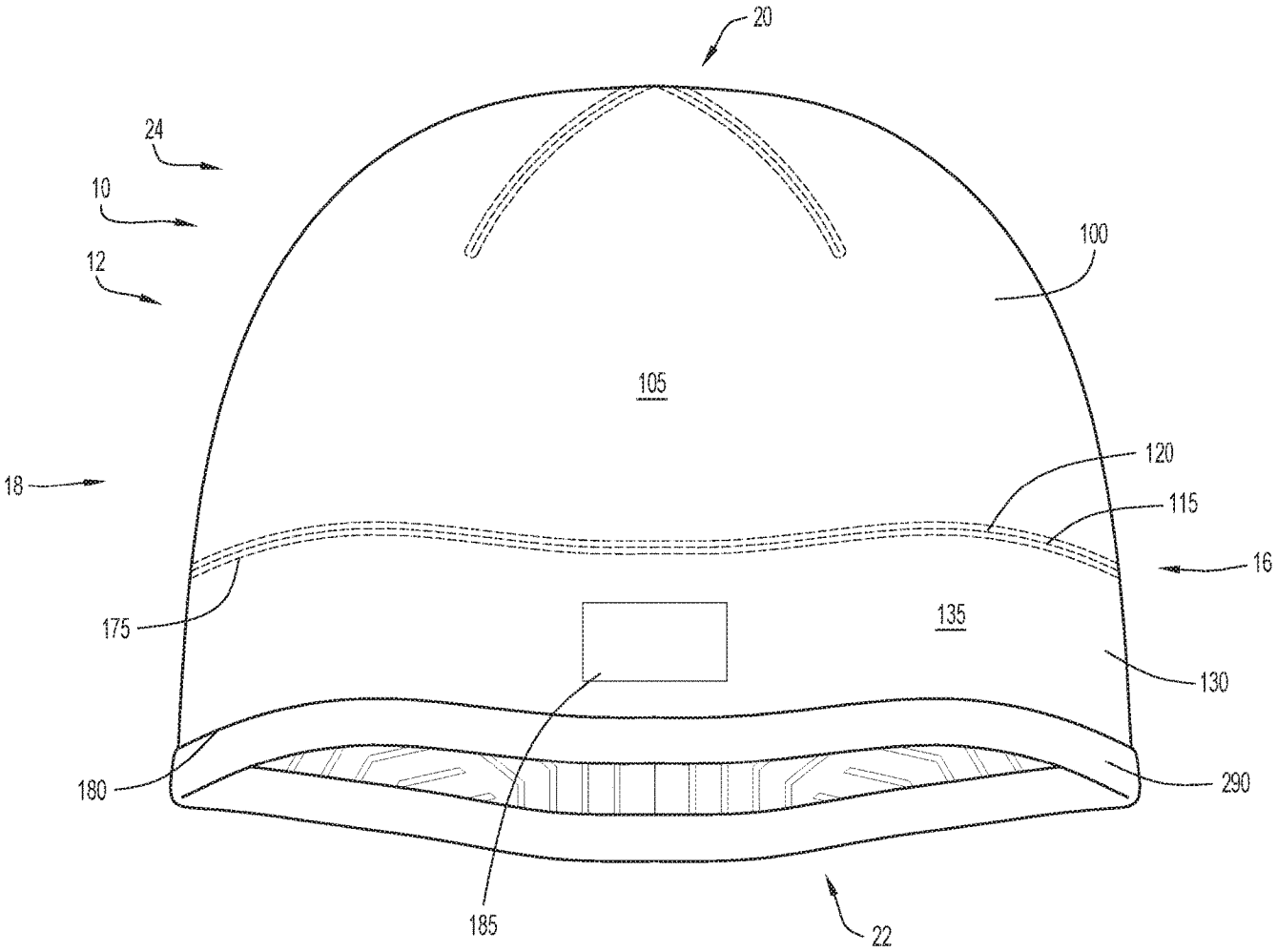
FIG. 1A illustrates a front view of the exterior surface of a beanie hat in accordance with an embodiment of the present invention.

Referring to FIGS. 1A, 1B, 2A, 2B, 3A, 3B, 4A, 4B, 5A, 5B, 6A, and 6B, a beanie hat 10 capable of receiving at least a portion of a human head is shown. The beanie hat 10 may be a head-hugging brimless hat or headwear. The beanie hat 10 includes a front side 12, a rear side 14 opposite the front side 12, a first side 16 spanning between the front side 12 and the rear side 14, and a second side 18 spanning between the front side 12 and the rear side 14 and disposed opposite of the first side 16. The beanie hat 10 further includes a top side 20, a bottom side 22, an exterior 24, and an interior 26. The beanie hat 10 illustrated is constructed of a first panel 100, a second panel 130, a third panel 190, and a fourth panel 240. The four panels 100, 130, 190, 240 are interconnected to form the beanie hat 10. The panels 100, 130, 190, 240 may be constructed from a knitted, woven, or nonwoven fabric with resilient or stretch properties, e.g., a breathable fabric including elastane resilient fabric configured to stretch in multiple (e.g., two way or four way stretch) directions. The fabric of the panels 100, 130, 190, 240 may further be wind resistant, water resistant, and/or water repellant.

Figure 1B:
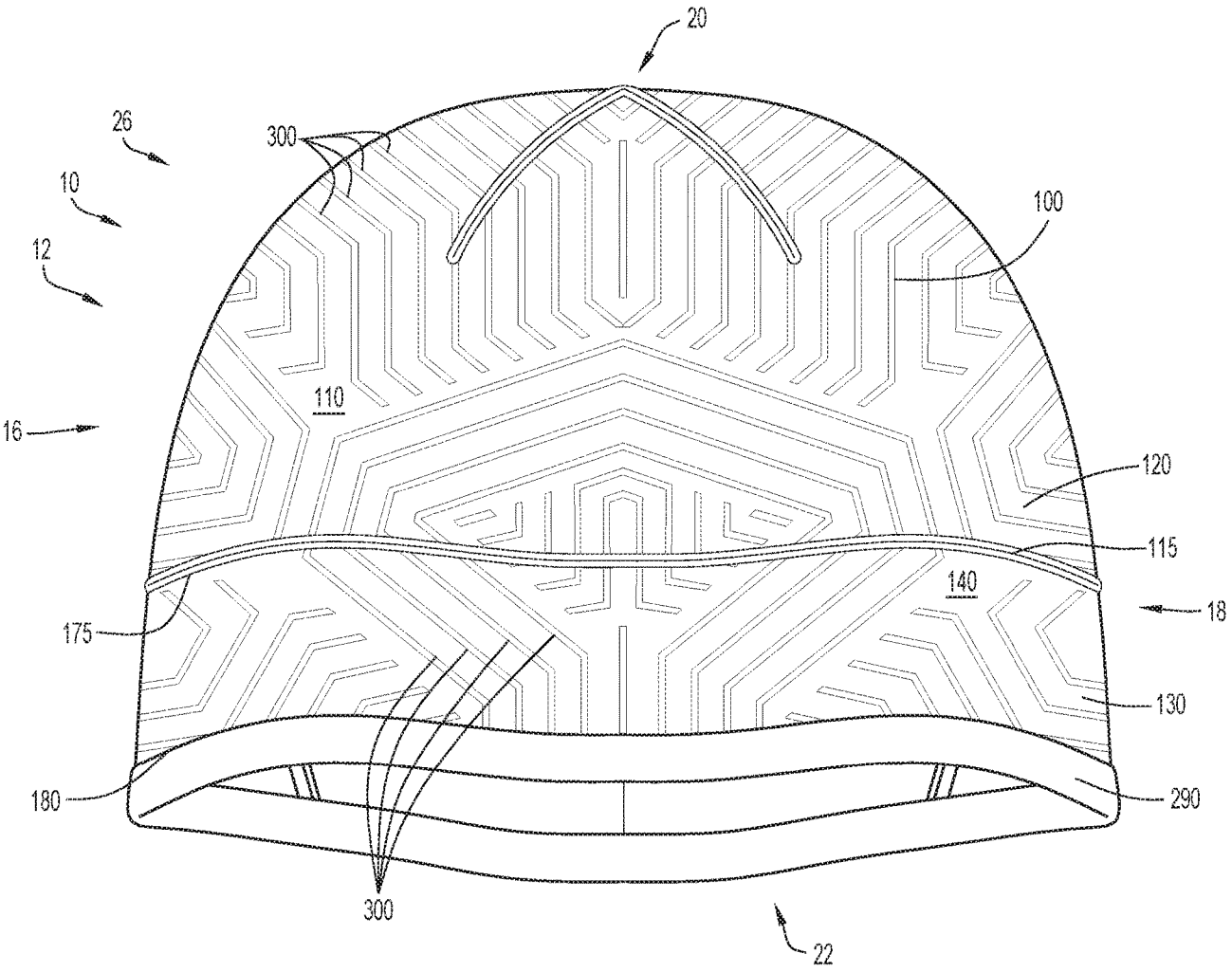
FIG. 1B illustrates a front view of the interior surface of the embodiment of the beanie hat illustrated in FIG. 1A.
Figure 2A:
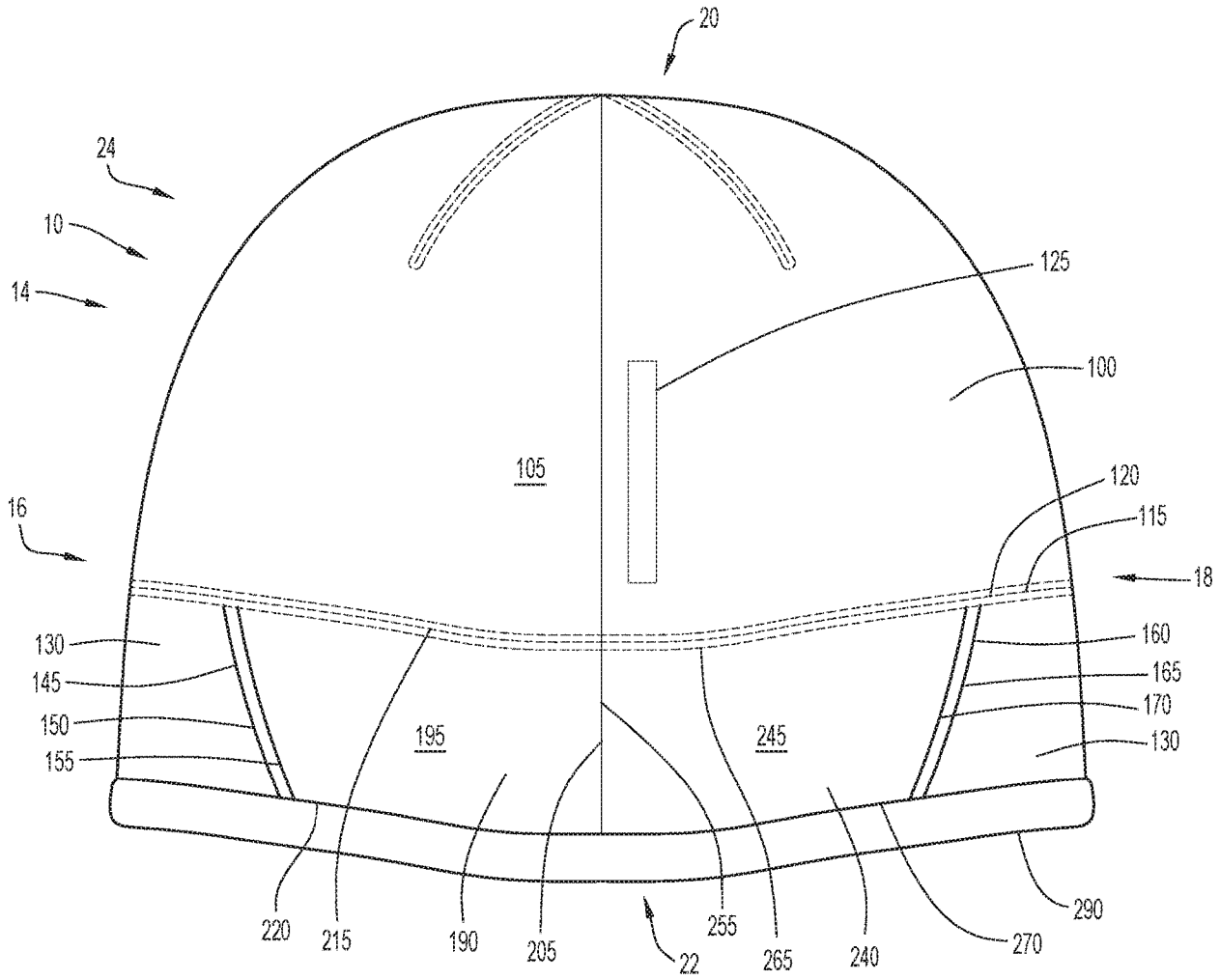
FIG. 2A illustrates a rear view of the exterior surface of the embodiment of the beanie hat illustrated in FIG. 1A.

Turning to FIGS. 1A, 1B, 2A, and 2B, the first panel 100 may be substantially dome shaped and includes an exterior surface 105 and an interior surface 110. The first panel 100 includes a continuous edge 115. As best illustrated in FIG. 2A, mounted on the exterior surface 105 of the first panel 100 is an icon or indicia 125. The indicia 125 may be a reflective material that provides additional visibility of the user wearing the beanie hat when light is shown in the direction of the user.

As further illustrated in FIGS. 1A and 1B, a second panel 130 is coupled to the first panel 100 proximate to the front side 12 of the beanie hat 10. The second panel 130 includes an exterior surface 135 and an interior surface 140. As further illustrated in FIGS. 2A and 2B, the second panel 130 includes a first terminal edge 145 disposed proximate to the first side 16 of the beanie hat 10 and a second terminal edge 160 disposed proximate to the second side 18 of the beanie hat 10. The second panel 130 further includes a top edge 175 and a bottom edge 180. The top edge 175 of the second panel 130 is attached to the edge 115 of the first panel 100 via stitching 120. As illustrated, the stitching 120 that couples the first panel 100 to the second panel 130 may be a flatlock stitch. However, other types of stitching may be used to couple the first panel 100 to the second panel 130. In addition, the first and second panel 100, 130 may be coupled to one another by other means, including, but not limited to, fusing the first and second panels 100, 130 together, bonding the first and second panels together 100, 130, etc. As best illustrated in FIG. 1A, the second panel 130 may include indicia 185 mounted on the exterior surface 135 of the second panel 130. In the example embodiment of the hat 10 depicted in the figures, the indicia 185 is located on the second panel 130 at a location equidistant between the first terminal edge 145 and the second terminal edge 160, and also equidistant from the top edge 175 and the bottom edge 180. However, indicia may be provided at any other one or more suitable locations along the second panel 130. Similar to the indicia 125 disposed on the first panel 100, the indicia 185 may also be constructed of a reflective material that provides additional visibility of the user wearing the beaning hat.

Figure 2B:
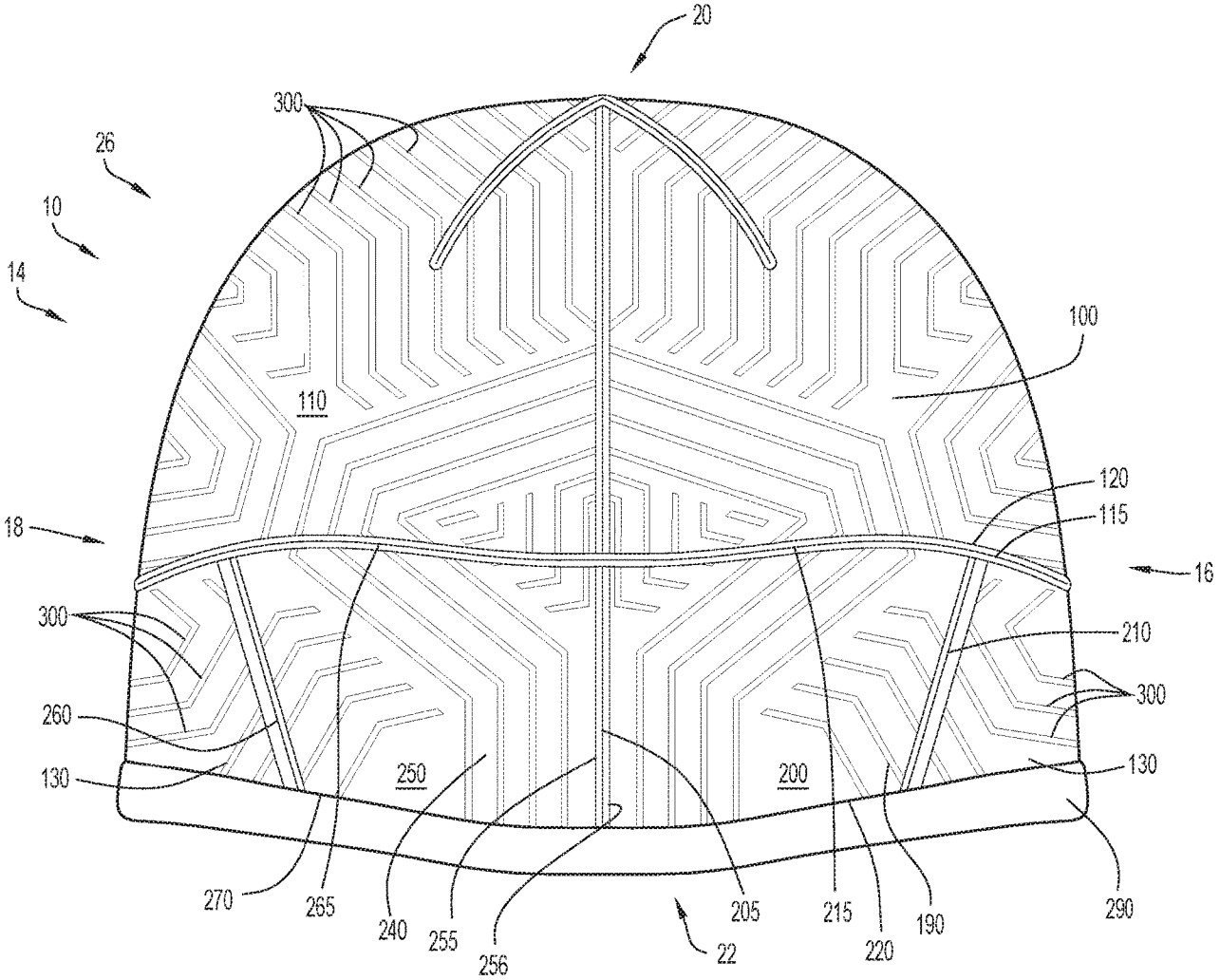
FIG. 2B illustrates a rear view of the interior surface of the embodiment of the beanie hat illustrated in FIG. 1A.

Turning to FIGS. 2A and 2B, a third panel 190 and a fourth panel 240 are coupled to the first panel 100 proximate to the rear side 14 of the beanie hat 10. As illustrated, the third panel 190 is disposed on the rear side 14 of the beanie hat 10 proximate to the first side 16 of the beanie hat 10, while the fourth panel 240 is disposed on the rear side 14 of the beanie hat 10 proximate to the second side 18 of the beanie hat 10. The third panel 190 includes an exterior surface 195 and an interior surface 200. The third panel 190 further includes a first terminal edge 205 and an opposite second terminal edge 210. The third panel 190 also includes a top edge 215 and a bottom edge 220. Similarly, the fourth panel 240 includes an exterior surface 245 and an interior surface 250. The fourth panel 240 also includes a first terminal edge 255, an opposite second terminal edge 260, a top edge 265 spanning between the first and second terminal edges 255, 260, and a bottom edge 270 opposite the top edge 265. Similar to that of the second panel 130, the top edge 215 of the third panel 190 and the top edge 265 of the fourth panel 240 are coupled to the edge 115 of the first panel 100. Stitching 120 may couple the top edge 215 of the third panel 190 and the top edge 265 of the fourth panel 240 to the first panel 130, where the stitching 120 may be a flatlock stitch. Other types of stitching, however, may be used to couple the first panel 100 to the third and fourth panels 190, 240. In addition, the first panel 100 may be coupled to the third and fourth panels 190, 240 by other means, including, but not limited to, fusing the third and fourth panels 190, 240 to the first panel 100, bonding the third and fourth panels 190, 240 to the first panel 100, etc.

As further illustrated in FIGS. 2A and 2B, the third and fourth panels 190, 240 are coupled to the first panel 100 such that the first terminal edge 205 of the third panel 190 is coupled to the first terminal edge 255 of the fourth panel 240. As best illustrated in FIG. 2B, the first terminal edge 205 of the third panel 190 is coupled to the first terminal edge 255 of the fourth panel 240 via stitching 256 on the interior 26 of the beanie hat 10. Stitching 256 may form any type of seam, including but not limited to, a flatlock seam, an overlock seam, blind stitch seam, etc. In addition, the third and fourth panels 190, 240 may be coupled to one another by other means, including, but not limited to, fusing, bonding, etc. As further illustrated in FIGS. 2A and 2B, the second terminal edge 210 of the third panel 190 is disposed proximate to the first terminal edge 145 of the second panel 130 with a slight overlap between the edges as described herein, while the second terminal edge 260 of the fourth panel 240 is disposed proximate to the second terminal edge 160 of the second panel 130 with a slight overlap between the edges as described herein.

Figure 3A:
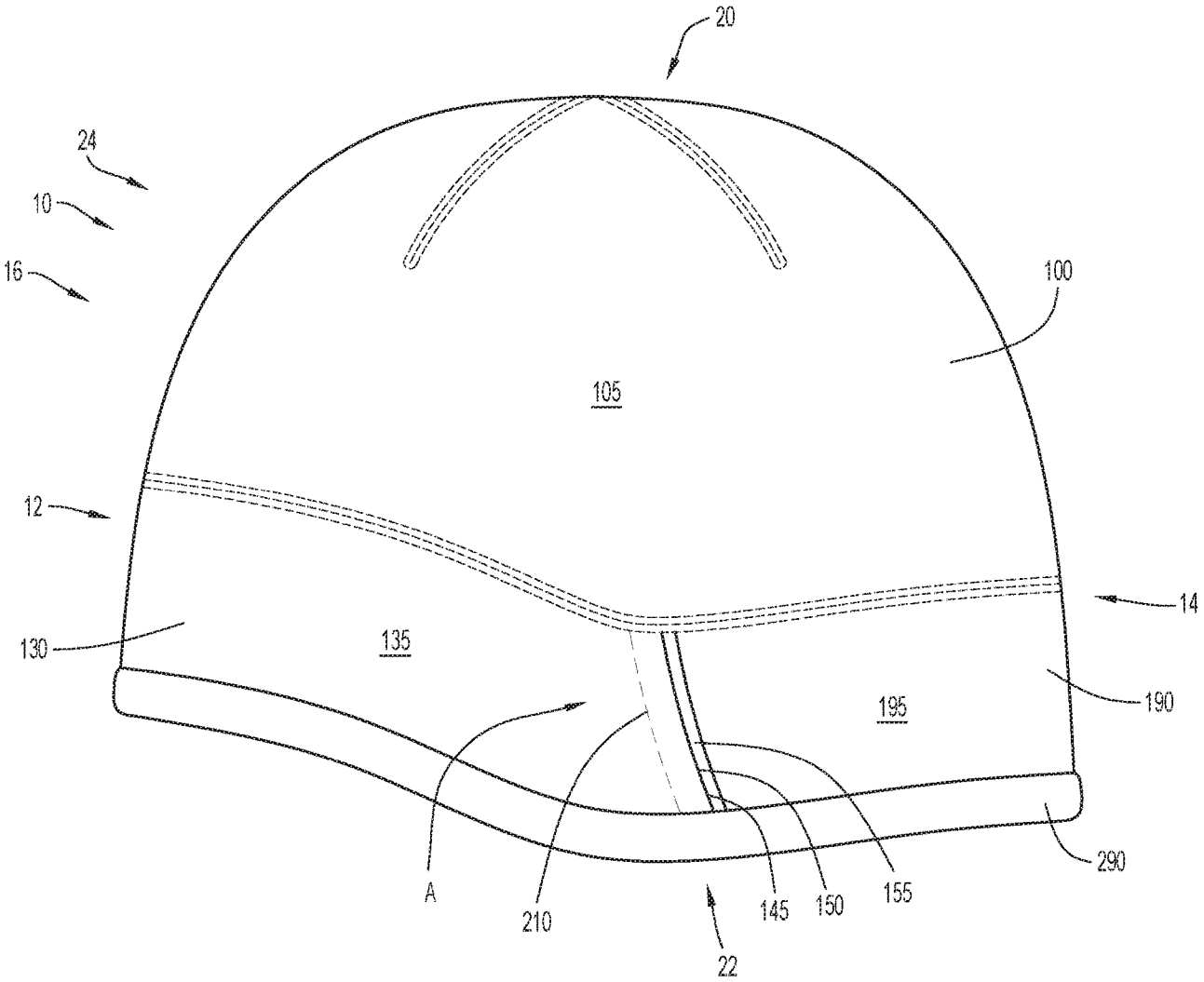
FIG. 3A illustrates a side elevational view of the exterior surface of the first side of the beanie hat illustrated in FIG. 1A, where the first pass-through opening is positioned in the closed position.
Figure 3B:
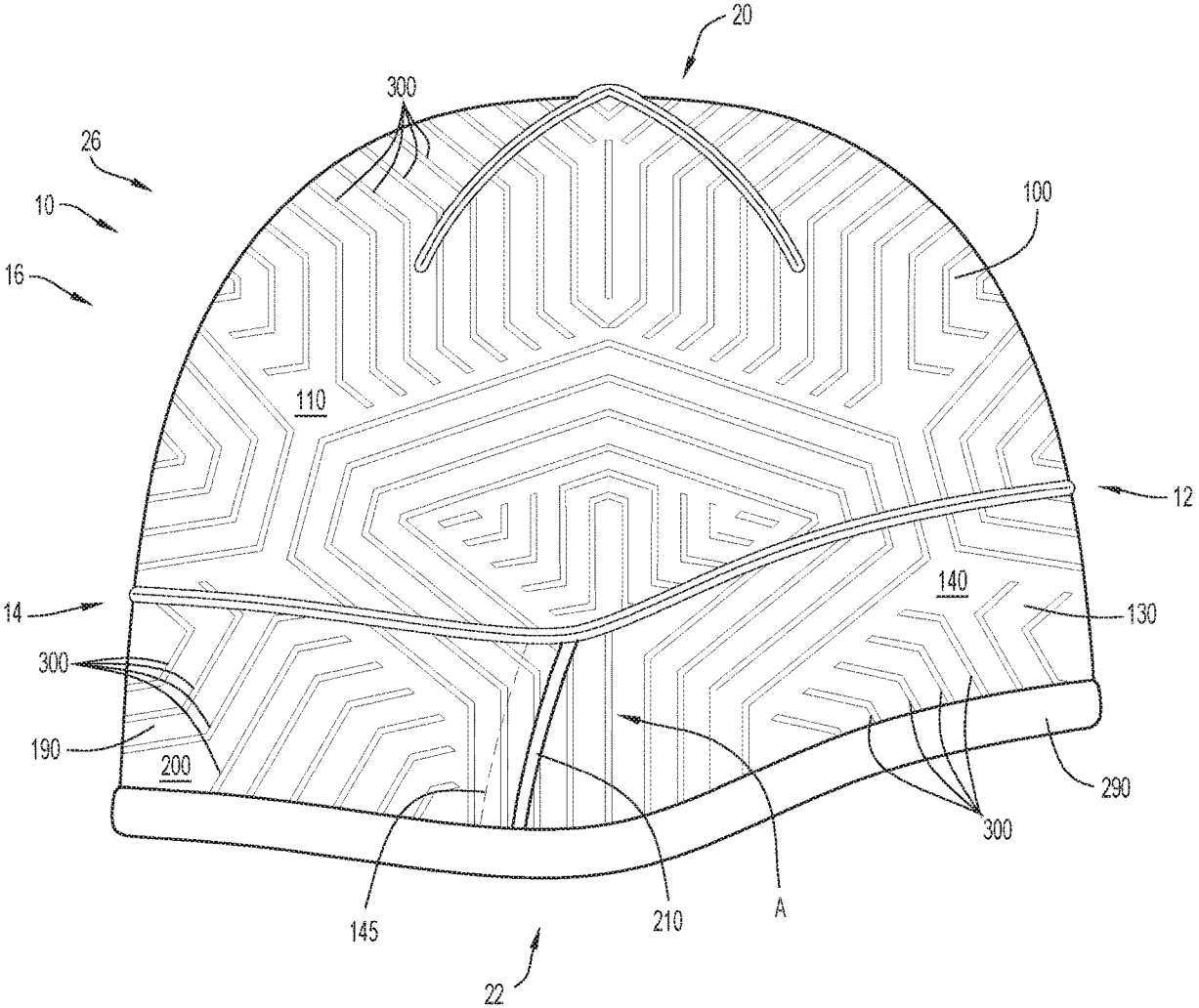
FIG. 3B illustrates a side elevational view of the interior surface of the first side of the beanie hat illustrated in FIG. 1A, where the first pass-through opening is positioned in the closed position.

Turning to FIGS. 3A and 3B, illustrated is the positioning of the first terminal edge 145 of the second panel 130 in relation to the second terminal edge 210 of the third panel 190 when the first terminal edge 145 and the second terminal edge 210 are in the closed position A. As best illustrated in FIG. 3A, on the exterior 24 of the beanie hat 10, and proximate to the first side 16 of the beanie hat 10, the first terminal edge 145 of the second panel 130 overlaps the second terminal edge 210 of the third panel 190 (shown as a phantom line in FIG. 3A). Conversely, as best illustrated in FIG. 3B, on the interior 26 of the beanie hat 10, and also proximate to the first side 16 of the beanie hat 10, the second terminal edge 210 of the third panel 190 overlaps the first terminal edge 145 of the second panel 130 (shown as a phantom line in FIG. 3B).

Figure 4A:
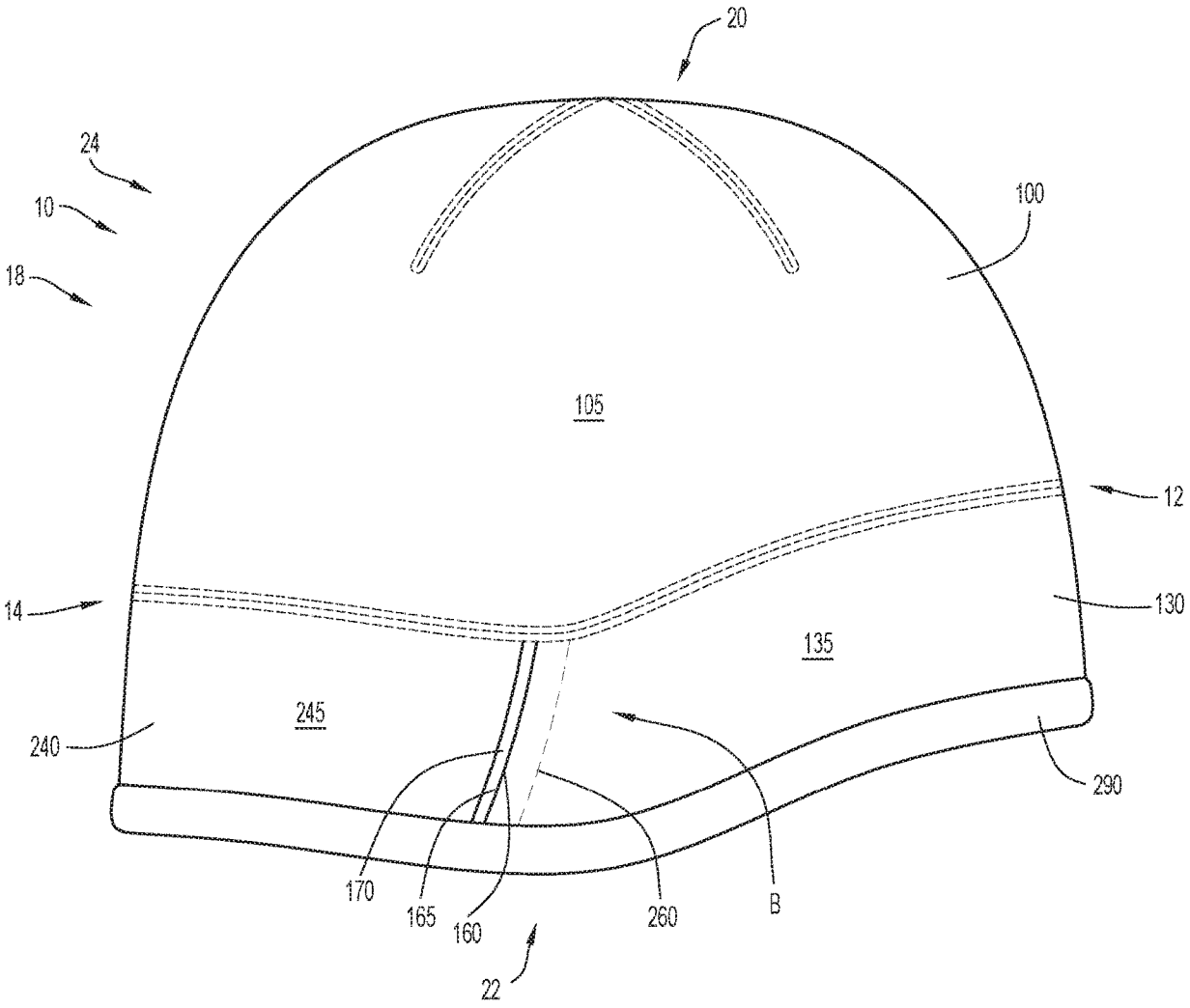
FIG. 4A illustrates a side elevational view of the exterior surface of second side of the embodiment of the beanie hat illustrated FIG. 1A, where the second pass-through opening is positioned in the closed position.
Figure 4B:
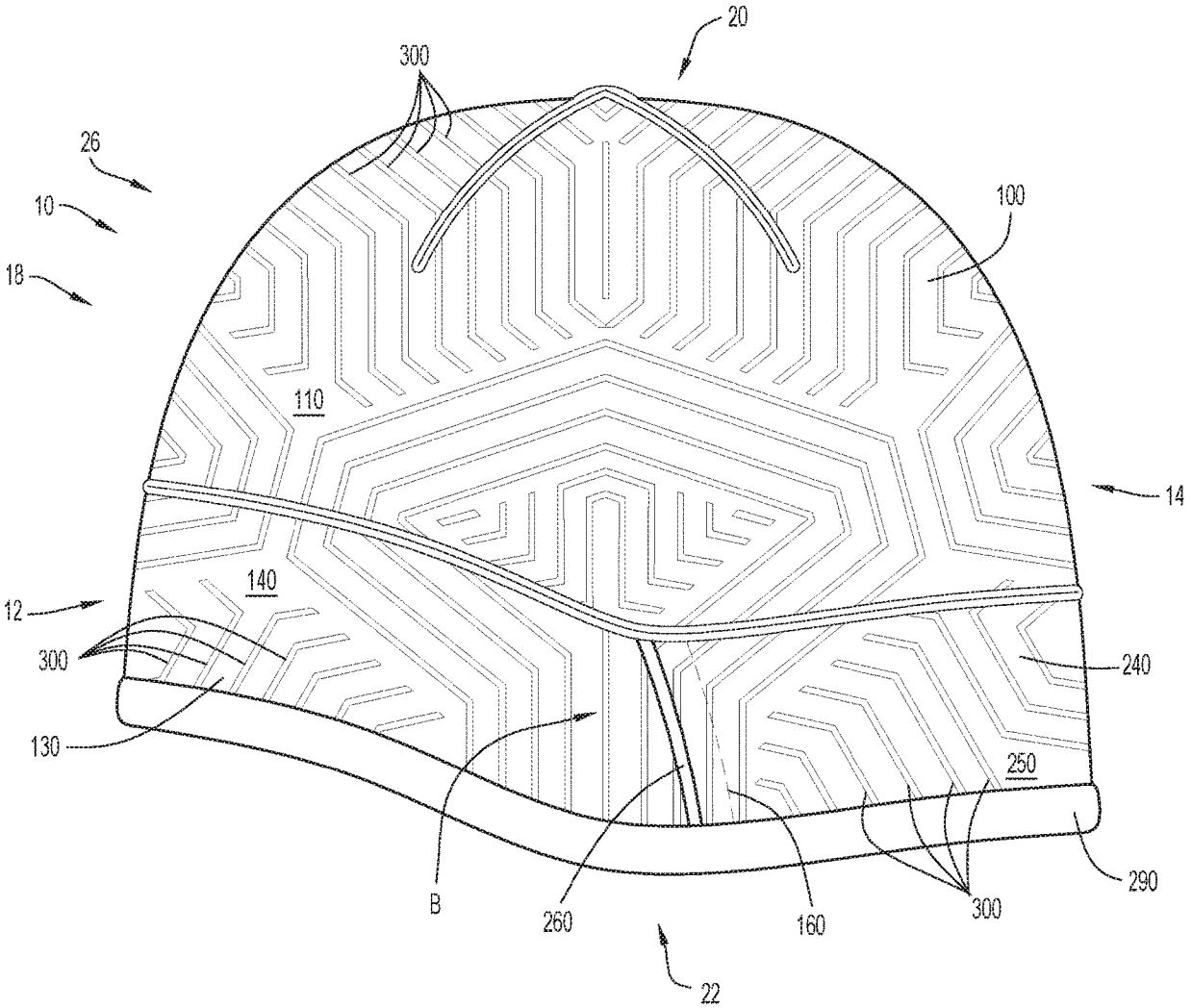
FIG. 4B illustrates a side elevational view of the interior surface of the second side of the embodiment of the beanie hat illustrated FIG. 1A, where the second pass-through opening is positioned in the closed position.

Turning to FIGS. 4A and 4B, illustrated is the positioning of the second terminal edge 160 of the second panel 130 in relation to the second terminal edge 260 of the fourth panel 240 when the second terminal edge 160 and the second terminal edge 260 are in the closed position B. As best illustrated in FIG. 4A, on the exterior 24 of the beanie hat 10, and proximate to the second side 18 of the beanie hat 10, the second terminal edge 160 of the second panel 130 overlaps the second terminal edge 260 of the fourth panel 240 (shown as a phantom line in FIG. 4A). Conversely, as best illustrated in FIG. 4B, on the interior 26 of the beanie hat 10, and also proximate to the second side 18 of the beanie hat 10, the second terminal edge 260 of the fourth panel 240 overlaps the second terminal edge 160 of the second panel 130 (shown as a phantom line in FIG. 4B).

Figure 5A:
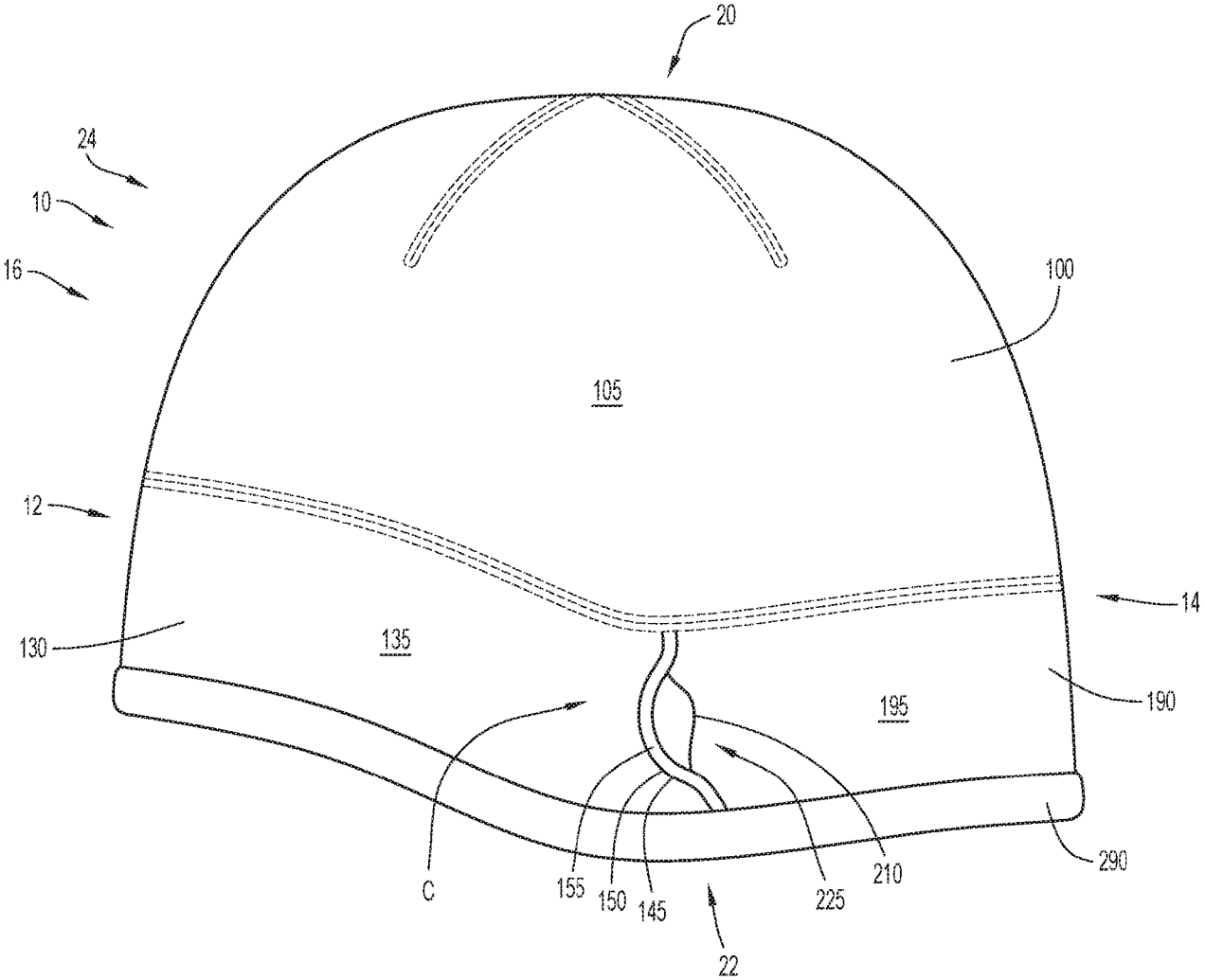
FIG. 5A illustrates a side elevational view of the exterior surface of the first side of the beanie hat illustrated in FIG. 1A, where the first pass-through opening is positioned in the opened position.
Figure 5B:
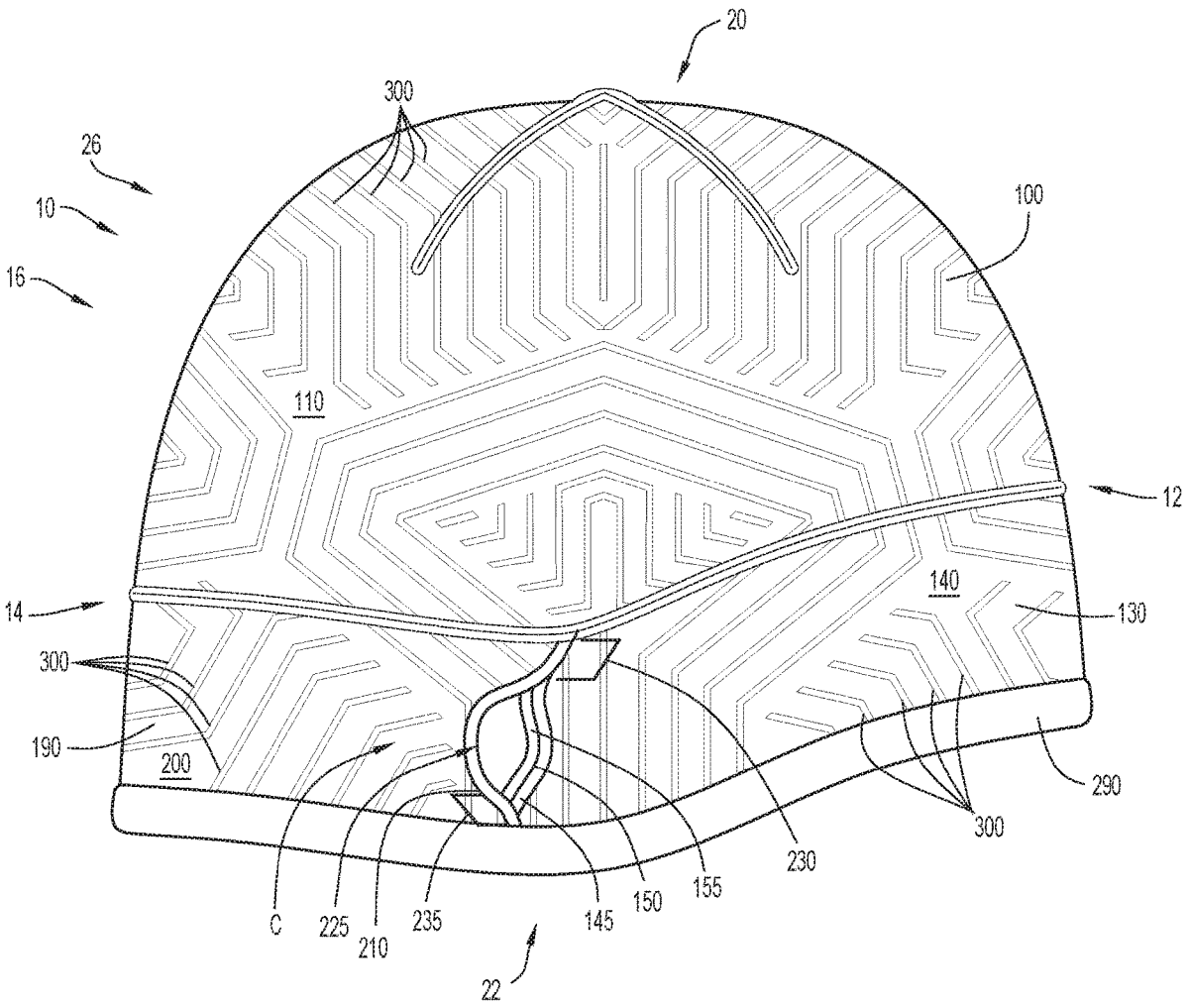
FIG. 5B illustrates a side elevational view of the interior surface of the first side of the beanie hat illustrated in FIG. 1A, where the first pass-through opening is positioned in the opened position.

Turning to FIGS. 5A and 5B, illustrated is the positioning of the first terminal edge 145 of the second panel 130 in relation to the second terminal edge 210 of the third panel 190 when the first terminal edge 145 and the second terminal edge 210 are in the opened position C. When in the opened position C, the first terminal edge 145 of the second panel 130 is at least partially separated from the second terminal edge 210 of the third panel 190. This partial separation of the first terminal edge 145 of the second panel 130 from the second terminal edge 210 of the third panel 190 creates a first opening 225. The first opening 225 enables objects, such as earbuds, to be threaded through the first opening 225 when the beanie hat 10 is worn by a user. The first opening 225 must be large enough to receive objects, such as earbuds, but must be small enough to retain the earbuds in the opening, and thus the ear, when the user wearing the hat 10 is performing activities, such as running.

As best illustrated in FIG. 5B, a portion of the first terminal edge 145 of the second panel 130 is folded towards the interior 26 of the beanie hat 10 and over the interior surface 140 of the second panel 130 to form a first capped end 150. Coupled to the first capped end 150 is reflective piping 155. The reflective piping 155 may be coupled to the first capped end 150 by, but not limited to, stitching, bonding, adhesives, etc. As best illustrated in FIG. 5A, the reflective piping 155 extends beyond the first capped end 150. The reflective piping 155 may be constructed from a reflective material wrapped around a structure, such as foam, a pipe, a cord, etc. The reflective material of the reflective piping 155 may be configured to reflect light to provide additional visibility of the user wearing the beanie hat 10 when light is directed in the user's direction. Furthermore, the reflective material and/or the inner structure of the reflective piping 155 may be of a non-resilient material that eases manipulation of the first terminal edge 145 to separate the first terminal edge 145 of the second panel 130 from the second terminal edge 210 of the third panel 190 when reconfiguring the first terminal edge 145 and the second terminal edge 210 from the closed position A to the opened position C. By constructing the reflective piping 155 of a material with a contrasting texture from that of the material of the second and third panels 130, 190, the user of the beanie hat 10 can more easily locate and separate the first terminal edge 145 from the second terminal edge 210 to thread objects through the first opening 225.

As further illustrated in FIG. 5B, the first terminal edge 145 of the second panel 130 may be coupled to the second terminal edge 210 of the third panel 190 by upper stitching 230 and lower stitching 235. Upper stitching 230 may couple a portion or region of the first terminal edge 145 of the second panel 130 to a portion or region of the second terminal edge 210 of the third panel 190 proximate to the top edge 175 of the second panel 130 and the top edge 215 of the third panel 190. The lower stitching 235 may couple a portion or region of the first terminal edge 145 of the second panel 130 to a portion or region of the second terminal edge 210 of the third panel 190 proximate to the bottom edge 180 of the second panel 130 and the bottom edge 220 of the third panel 190. The upper and lower stitching 230, 235 may enable deformation and separation of a portion of the first terminal edge 145 of the second panel 130 from a portion of the second terminal edge 210 of the third panel 190 when a user pulls on the reflective material 155 of the first terminal edge 145. Thus, the coupling of the first terminal edge 145 to the second terminal edge 210 by the upper and lower stitching 230, 235 causes the second terminal edge 210 of the third panel 190 to simultaneously move away from the first terminal edge 145 of the second panel 130 as the first terminal edge 145 is manipulated by the user wearing the beanie hat 10. The separation of a portion of the second terminal edge 210 of the third panel 190 from a portion of the first terminal edge 145 of the second panel 130 creates the first opening 225.

Figure 6A:
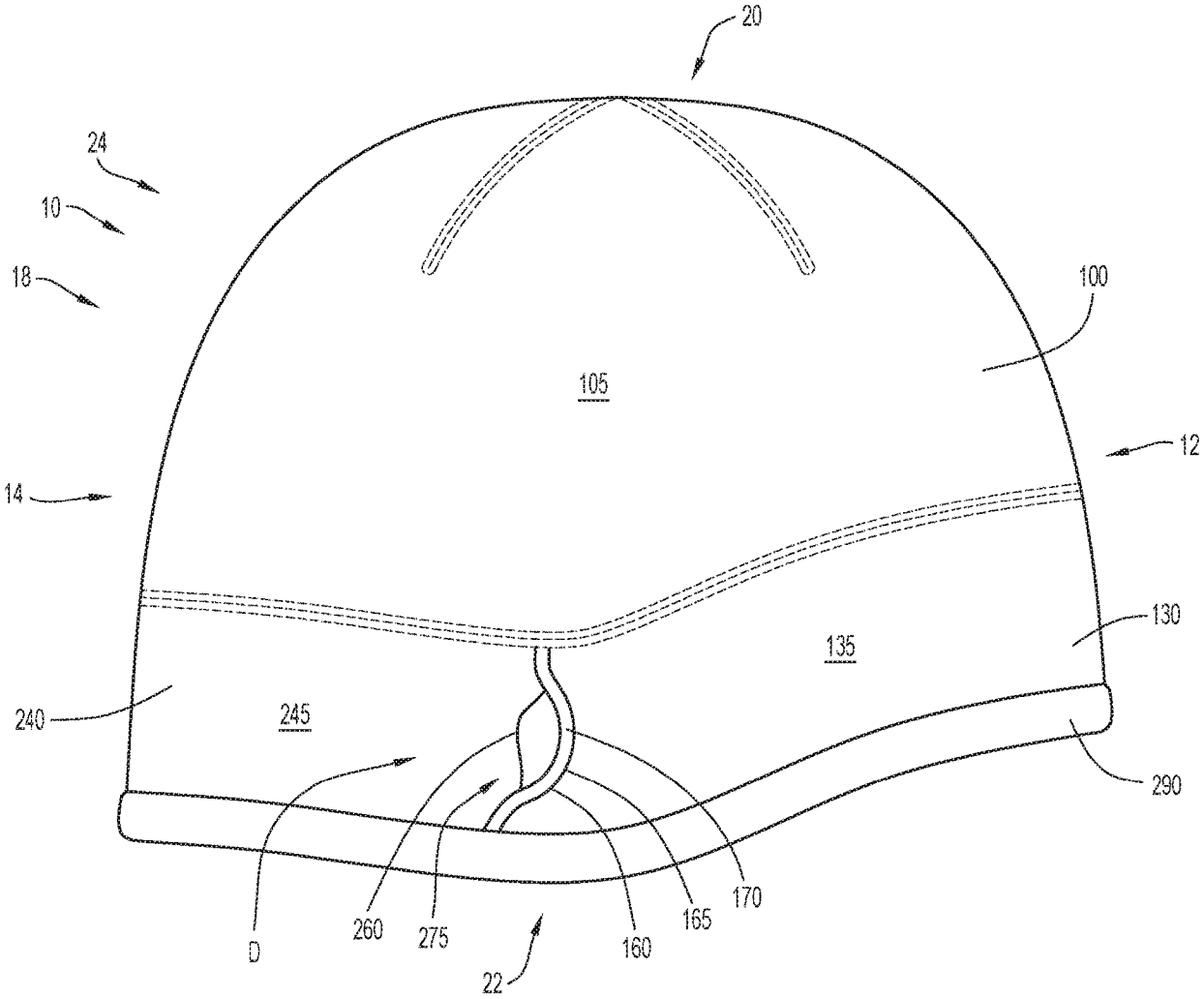
FIG. 6A illustrates a side elevational view of the exterior surface of the second side of the beanie hat illustrated FIG. 1A, where the second pass-through opening is positioned in the opened position.
Figure 6B:
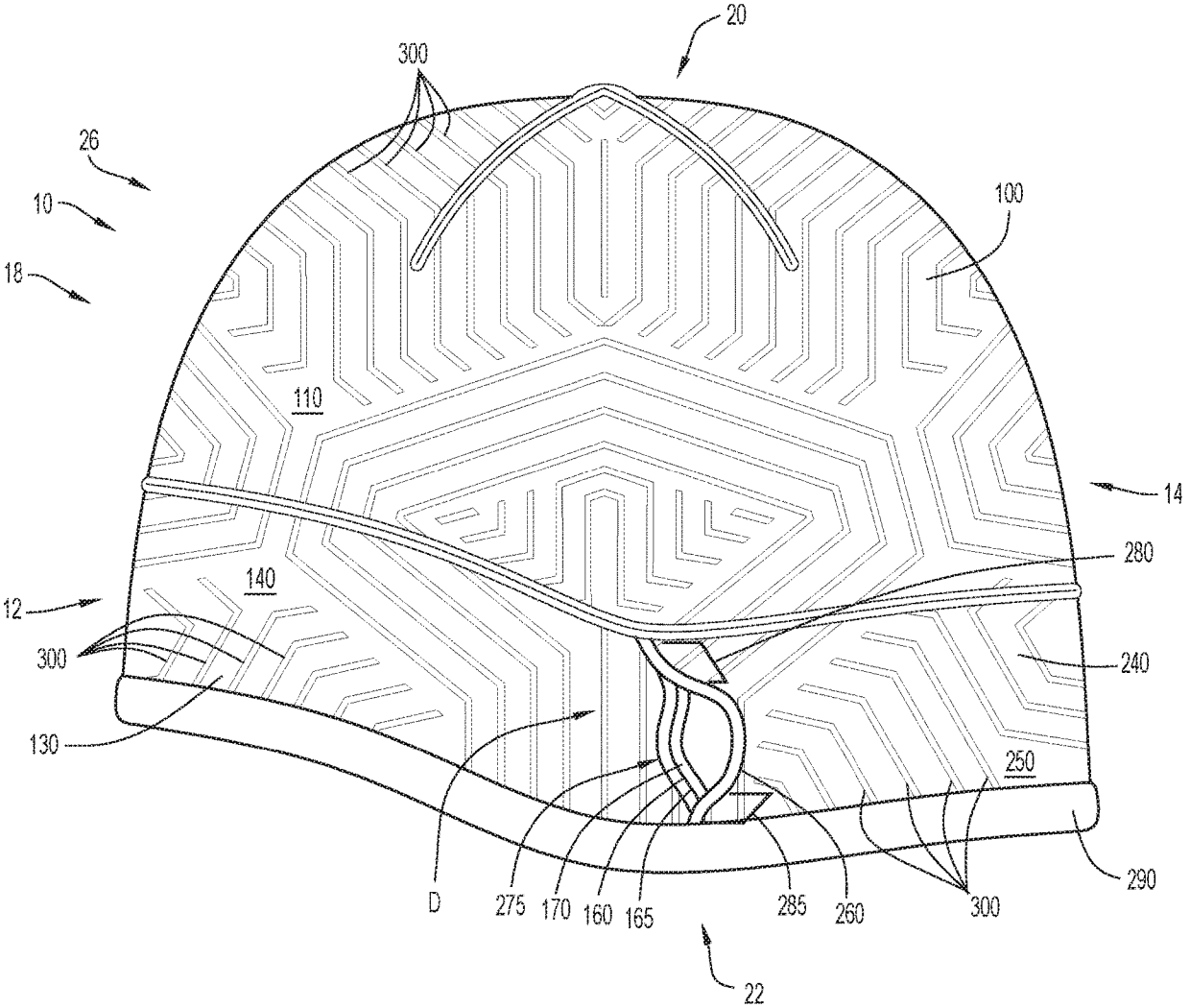
FIG. 6B illustrates a side elevational view of the interior surface of the second side of the embodiment of the beanie hat illustrated FIG. 1A, where the second pass-through opening is positioned in the opened position.

Turning to FIGS. 6A and 6B, illustrated is the positioning of the second terminal edge 160 of the second panel 130 in relation to the second terminal edge 260 of the fourth panel 240 when the second terminal edges 160, 260 are in the opened position D. When in the opened position D, the second terminal edge 160 of the second panel 130 is separated from the second terminal edge 260 of the fourth panel 190. The separation of the second terminal edge 160 of the second panel 130 from the second terminal edge 260 of the fourth panel 190 creates a second opening 275. Similar to the first opening 225, the second opening 275 enables objects, such as earbuds, to be threaded through the second opening 275 when the beanie hat 10 is worn by a user. In addition, the second opening 275 must be large enough to receive objects, such as earbuds, but must be small enough to retain the earbuds in the opening, and thus the ear, when the user wearing the hat 10 performing activities.

As best illustrated in FIG. 6B, a portion of the second terminal edge 160 of the second panel 130 is folded towards the interior 26 of the beanie hat 10 and over the interior surface 140 of the second panel 130 to form a second capped end 165. Coupled to the second capped end 165 is reflective piping 170. The reflective piping 170 may be coupled to the second capped end 165 by, but not limited to, stitching, bonding, adhesives, etc. As best illustrated in FIG. 6A, the reflective piping 170 extends beyond the second capped end 165. Similar to the reflective piping 155, the reflective piping 170 may be constructed from a reflective material wrapped around a structure, such as foam, a pipe, a cord, etc. The reflective material of the reflective piping 170 may be configured to reflect light to provide additional visibility of the user wearing the beanie hat 10 when light is shown in the direction of the user. Furthermore, the reflective material and/or the inner structure of the reflective piping 170 may be of a non-resilient material that eases manipulation of the second terminal edge 160 in order to separate the second terminal edge 160 of the second panel 130 from the second terminal edge 260 of the fourth panel 240 when reconfiguring the second terminal edges 160, 260 from the closed position B to the opened position D. By constructing the reflective piping 170 of a material with a contrasting texture from that of the material of the second and fourth panels 130, 240, the user of the beanie hat 10 can more easily locate and separate the second terminal edge 160 from the second terminal edge 260 to thread objects through the second opening 275.

As further illustrated in FIG. 6B, the second terminal edge 160 of the second panel 130 may be coupled to the second terminal edge 260 of the fourth panel 240 by upper stitching 280 and lower stitching 285. Upper stitching 280 may couple a portion or region of the second terminal edge 160 of the second panel 130 to a portion or region of the second terminal edge 260 of the fourth panel 240 proximate to the top edge 175 of the second panel 130 and the top edge 265 of the fourth panel 240. The lower stitching 285 may couple a portion or region of the second terminal edge 160 of the second panel 130 to a portion or region of the second terminal edge 260 of the fourth panel 240 proximate to the bottom edge 180 of the second panel 130 and the bottom edge 270 of the fourth panel 240. The upper and lower stitching 280, 285 may enable deformation and separation of a portion of the second terminal edge 160 of the second panel 130 from a portion of the second terminal edge 260 of the fourth panel 240 when a user pulls on the reflective material 170 of the second terminal edge 160. Thus, the coupling of the second terminal edge 160 to the second terminal edge 260 by the upper and lower stitching 280, 285 causes the second terminal edge 260 of the fourth panel 240 to simultaneously move away from the second terminal edge 160 of the second panel 130 as the second terminal edge 160 is manipulated by the user wearing the beanie hat 10. The movement of the second terminal edge 260 of the fourth panel 240 away from the second terminal edge 160 of the second panel 130 creates the second opening 275.

When the beanie hat 10 is worn by a user, the overlap of the terminal edges 145, 160 of the second panel 130 with the second terminal edges 210, 260 of the third and fourth panels 190, 240, respectively, are positioned proximate to, or over, the ears of the user. Thus, when the beanie hat 10 is worn by a user, the first and second openings 225, 275 are also positioned proximate to, or over, the ears of the user. It then follows that the second panel 130 may be disposed proximate to the forehead of the user, while the third and fourth panels 190, 240 are disposed proximate to the back of the head of the user. As illustrated in FIGS. 3A and 4A, by having the first terminal edge 145 of the second panel 130 overlap the second terminal edge 210 of the third panel 190 on the exterior 24 of the beanie hat 10, and by having the second terminal edge 160 of the second panel 130 overlap the second terminal edge 260 of the fourth panel 240 on the exterior 24 of the beanie hat 10, the first and second openings 225, 275 open towards the rear side 14 of the hat 10. This rear entry of the first and second openings 225, 275 enables earbuds threaded through the openings 225, 275 to remain in place in the ears of the user wearing the hat 10. Furthermore, by having the terminal edges 145, 160 of the second panel 130, which is disposed on the front side 12 of the hat 10, overlap the second terminal edge 210 of the third panel 190 and the second terminal edge 260 of the fourth panel 250, wind and precipitation is prevented from entering the openings 225, 275 while the user wearing the hat 10 is performing activities (e.g., running, jogging, cycling, etc.).

As illustrated in FIGS. 1A, 1B, 2A, 2B, 3A, 3B, 4A, 4B, 5A, 5B, 6A, and 6B, coupled to the bottom edge 180 of the second panel 130, the bottom edge 220 of the third panel 190, and the bottom edge 270 of the fourth panel 240 is an encircling member 290. The encircling member 290 may be configured to further interconnect the second panel 130, third panel 190, and the fourth panel 240. The encircling member 290 may be configured to wrap around the circumference of the user's head, and secure the beanie hat 10 to the head of the user. Additionally, encircling member 290 may be constructed from the same material as the first, second, third, and fourth panels 100, 130, 190, 240. In another embodiment, the encircling member 290 may be constructed from a material have a lesser degree of resiliency or stretch than the material from which the first, second, third, and fourth panels 100, 130, 190, 240 are constructed. As illustrated in FIGS. 1A, 1B, 3A, 3B, 4A, and 4B, the encircling member 290 and the bottom edge 180 of the second panel 130 contains a curved or arcuate profile. The curvature of the bottom edge 180 of the second panel 130 and the portion of the encircling member 290 proximate to the second panel 130 enables the first and second sides 16, 18 of beanie hat 10 to fully cover the ears of the user wearing the beanie hat 10 while the front 12 of the beanie hate 10 is disposed above the eyes of the user wearing the beanie hate 10. Thus, the curvature of the of the bottom edge 180 of the second panel 130 and the portion of the encircling member 290 proximate to the second panel 130 prevents the front 12 of the beanie hat 10 from covering the eyes of the user wearing the beanie hat 10 when the user positions the beanie hat 10 such that the first and second openings 225, 275 are disposed proximate to the user's ears and the first and second sides 16, 18 cover the user's ears.

As illustrated in FIGS. 1B, 2B, 3B, 4B, 5B, and 6B, disposed on the interior surface 110 of the first panel 100, the interior surface 140 of the second panel 130, the interior surface 200 of the third panel 190, and the interior surface 250 of the fourth panel 240 is a heat retaining coating 300. The heat retaining coating 300 may be disposed on the interior surfaces 110, 140, 200, 250 of the panels 100, 130, 190, 240 by, but not limited to, infusing the heat retaining coating 300 into the material of the panels 100, 130, 190, 240, bonding the heat retaining coating 300 to the interior surfaces 110, 140, 200, 250 of the panels 100, 130, 190, 240, or adhering the heat retaining coating 300 to the interior surfaces 110, 140, 200, 250 of the panels 100, 130, 190, 240. The heat retaining coating 300 may be configured to reflect some degree of heat radiated from the head of the user back onto the head of the user to further aid in keeping the head of the user warm. The heat retaining coating 300, in conjunction with the panels 100, 130, 190, 240 of the headwear 10, help to retain the generated heat around the portion the head covered by the headwear 10. The heat retaining coating 300 may be an aluminate ($AlO_2$), a zinc oxide (ZnO), a tin dioxide ($SnO_2$), a titanium dioxide ($TiO_2$), a silicon dioxide ($SiO_2$), a silicon carbide (SiC), a zirconium carbide (ZrC), or any combination thereof. Furthermore, as illustrated in FIGS. 1B, 2B, 3B, 4B, 5B, and 6B, the heat retaining coating 300 may be disposed on the interior surfaces the interior surfaces 110, 140, 200, 250 of the panels 100, 130, 190, 240 in striations or lines.

In other example embodiments, the headwear with pass-through slots can be implemented in configurations other than a beanie hat.

For example, the present invention can be implemented in the form of a headband. Turning to FIGS. 7A, 7B, 8A, 8B, 9A, 9B, 10A, 10B, 11A, 11B, 12A, and 12B, a headband 40 capable of receiving at least a portion of a human head is shown. The headband 40 may be a head-hugging brimless and topless headpiece that is configured to wrap around a user's head while leaving the top of the head exposed. The headband 40 includes a front side 42, a rear side 44 opposite the front side 42, a first side 46 spanning between the front side 42 and the rear side 44, and a second side 48 spanning between the front side 42 and the rear side 44 and disposed opposite of the first side 46. The headband 40 further includes a top side 50, a bottom side 52, an exterior 54, and an interior 56. The headband 40 is constructed from a first panel 400 and a second panel 460 that are interconnected. The panels 400, 460 may be constructed from a knitted, woven, or nonwoven fabric with resilient or stretch properties, e.g., a breathable fabric including elastane resilient fabric configured to stretch in multiple directions (e.g., two way stretch or four way stretch). The fabric of the panels 400, 460 may further be wind resistant, water resistant, and/or water repellant.

Figure 7A:
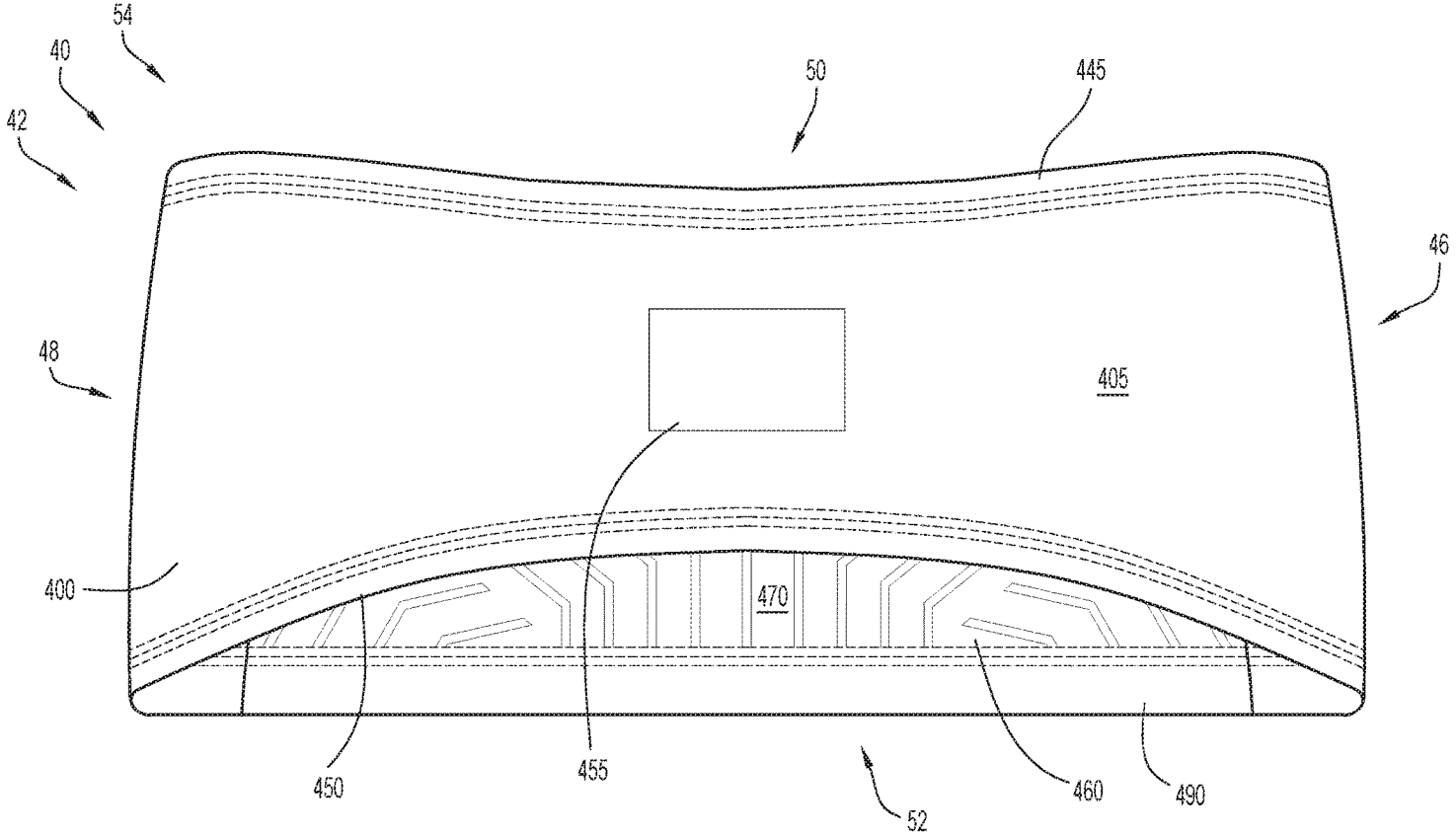
FIG. 7A illustrates a front view of the exterior surface of a headband in accordance with an embodiment of the present invention.
Figure 7B:
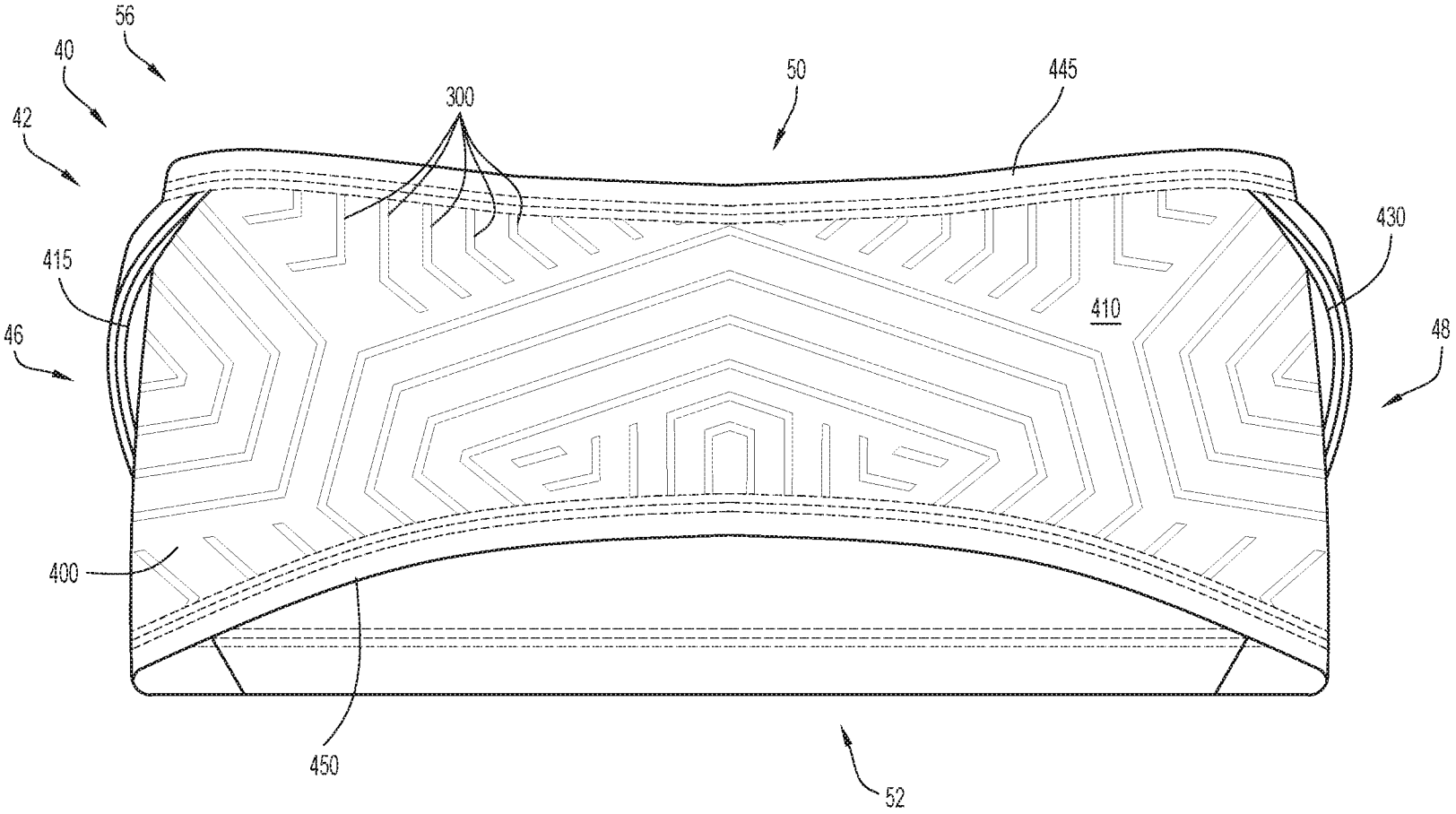
FIG. 7B illustrates a front view of the interior surface of the embodiment of the headband illustrated in FIG. 7A.

As illustrated in FIGS. 7A and 7B, the first panel 400 of the headband 40 is disposed on the front side 42 of the headband 40. The first panel 400 includes an exterior surface 405 and an interior surface 410. In addition, the first panel 400 includes a first terminal edge 415 disposed proximate to the first side 46 of the headband 40 and a second terminal edge 430 disposed proximate to the second side 48 of the headband 40. The first panel 400 further includes a top edge 445 and a bottom edge 450. As best illustrated in FIG. 7A, the first panel 400 may include indicia 455 disposed on the exterior surface 405. In the example embodiment shown in the figures, the indicia 455 is located on the first panel 400 at a location equidistant between the first terminal edge 415 and the second terminal edge 430, and also equidistant from the top edge 445 and the bottom edge 450. However, one of more forms of indicia may be provided at any one or more suitable locations on one or more panels of the headband. Similar to the indicia 125 and the indicia 185 of beanie hat 10, the indicia 455 may be constructed of a reflective material that provides additional visibility of the user wearing the headband.

Figure 8A:
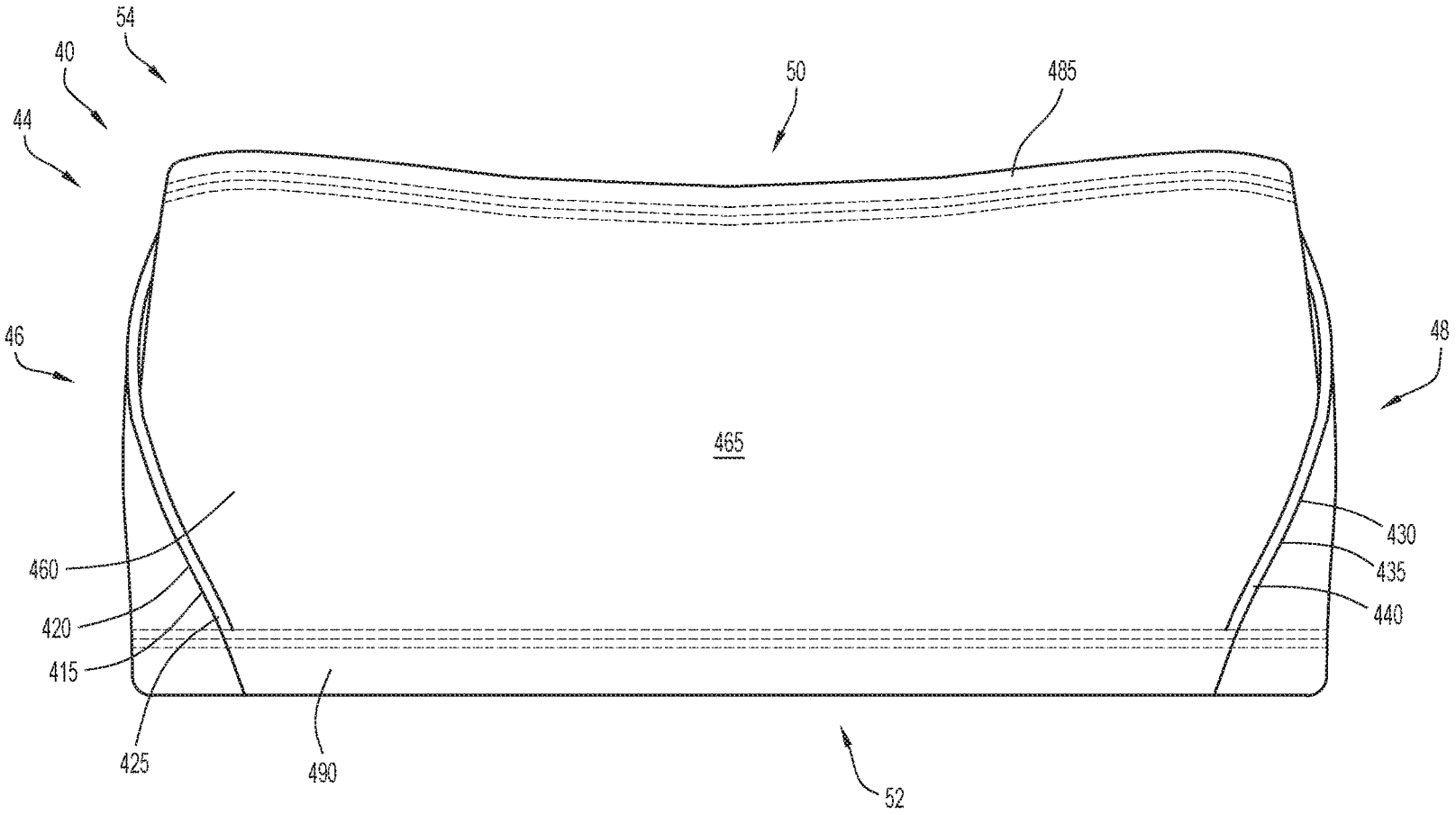
FIG. 8A illustrates a rear view of the exterior surface of the embodiment of the headband illustrated in FIG. 7A.
Figure 8B:
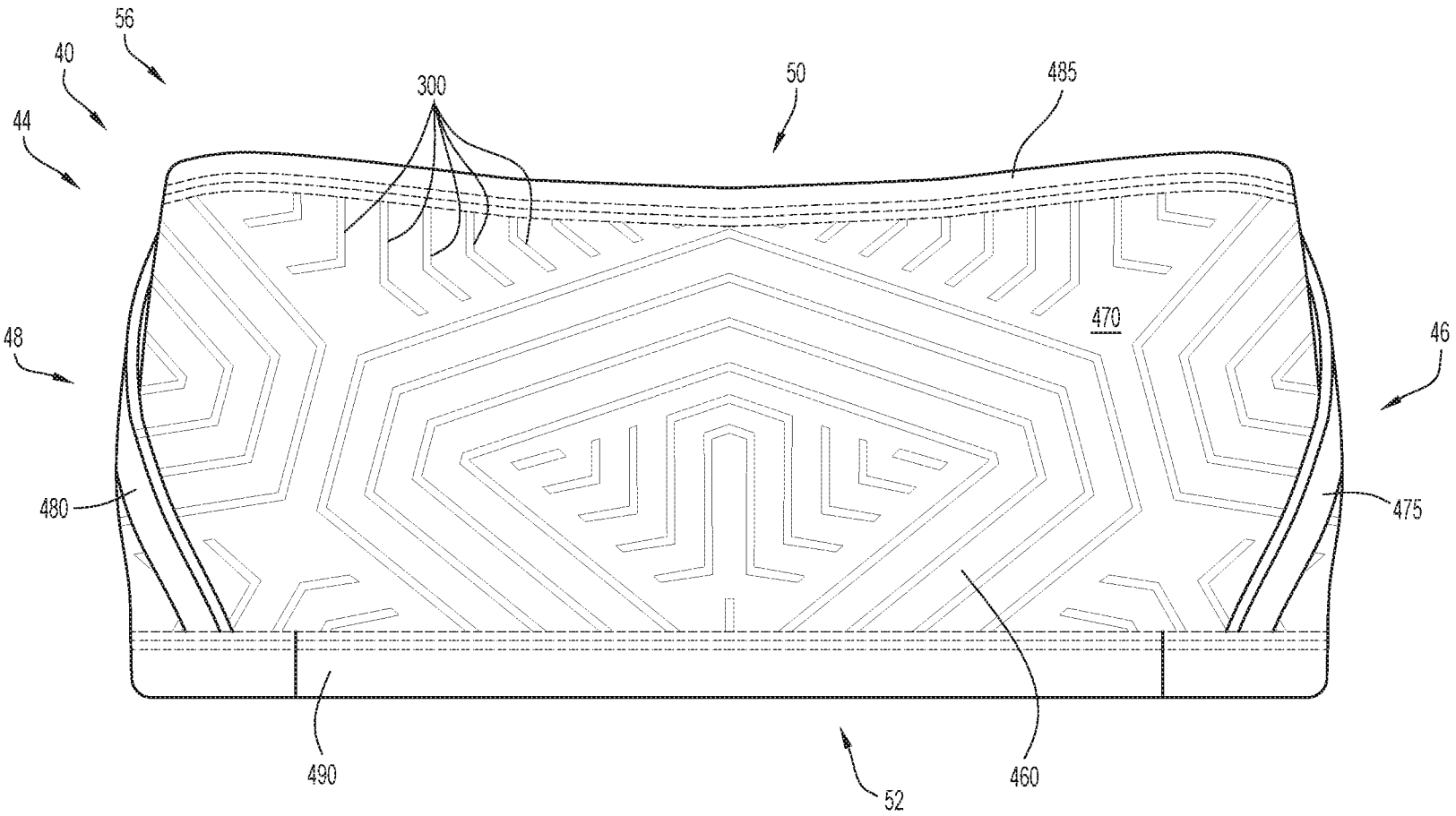
FIG. 8B illustrates a rear view of the interior surface of the embodiment of the headband illustrated in FIG. 7A.

Turning to FIGS. 8A and 8B, a second panel 460 is coupled to the first panel 400 and is disposed on the rear side 44 of the headband 40. As illustrated, the second panel 460 contains an exterior surface 465 (illustrated in FIG. 8A) and an opposite interior side 470 (illustrated in FIG. 8B). The second panel 460 further includes a first terminal edge 475 and an opposite second terminal edge 480. Spanning between the first terminal edge 475 and the second terminal edge 480 are a top edge 485 and a bottom edge 490.

As illustrated in FIGS. 7A, 7B, 9A, 9B, 10A, and 10B, the bottom edge 450 of the first panel 400 contains a curved or arcuate profile that differs from that of the bottom edge 490 of the second panel 460. The curvature of the bottom edge 450 of the first panel 400 enables the first and second sides 46, 48 of headband 40 to fully cover the ears of the user wearing the headband 40 while the front 42 of the headband 40 is disposed above the eyes of the user wearing the headband 40. Thus, the curvature of the bottom edge 450 of the first panel 400 prevents the front 42 of the headband 40 from covering the eyes of the user wearing the headband 40 when the user positions the headband 40 such that the first and second sides 46, 48 of the headband 40 cover the user's ears.

Figure 9A:
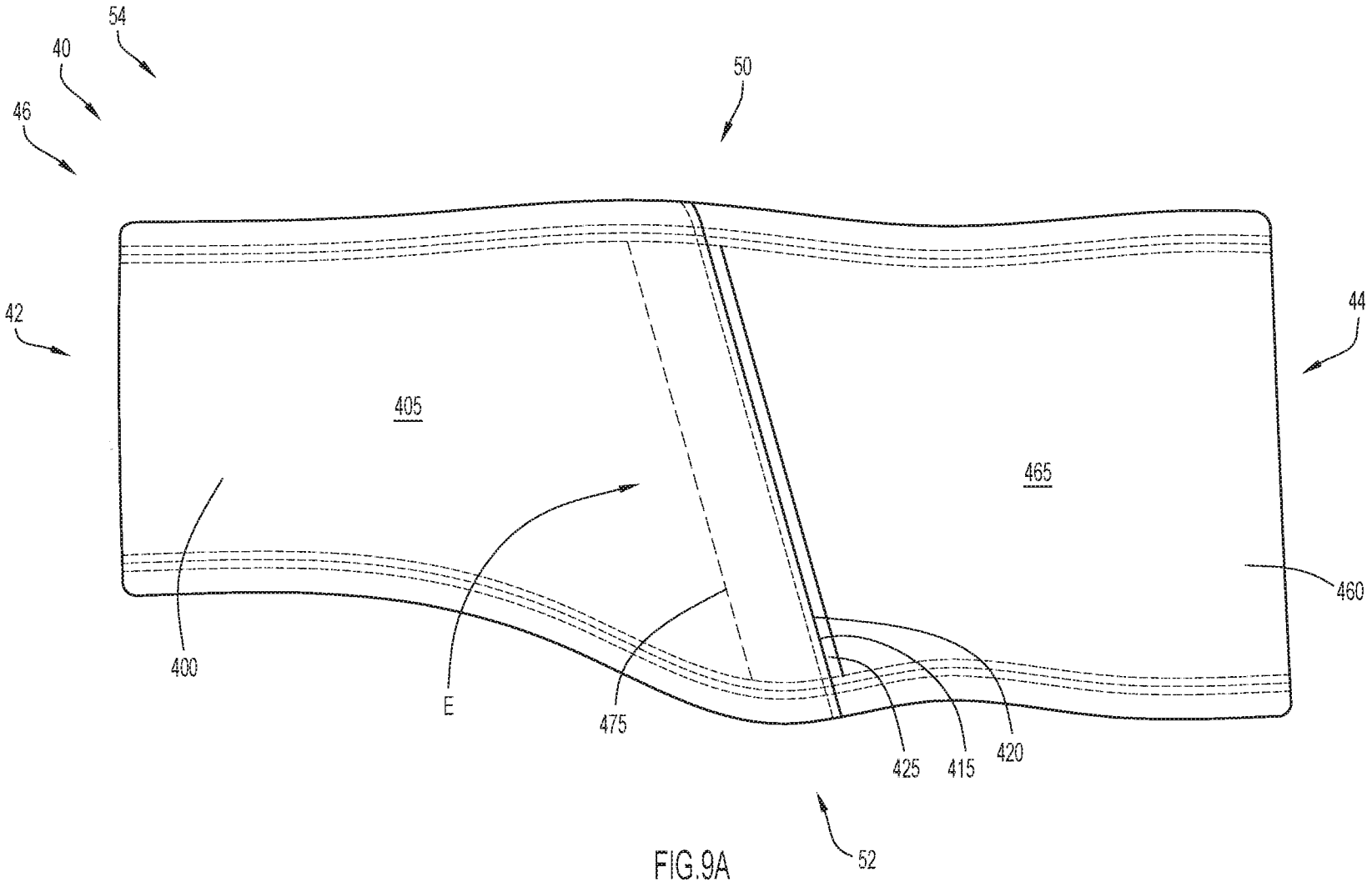
FIG. 9A illustrates a side elevational view of the exterior surface of the first side of the headband illustrated in FIG. 7A, where the first pass-through opening is positioned in the closed position.
Figure 9B:
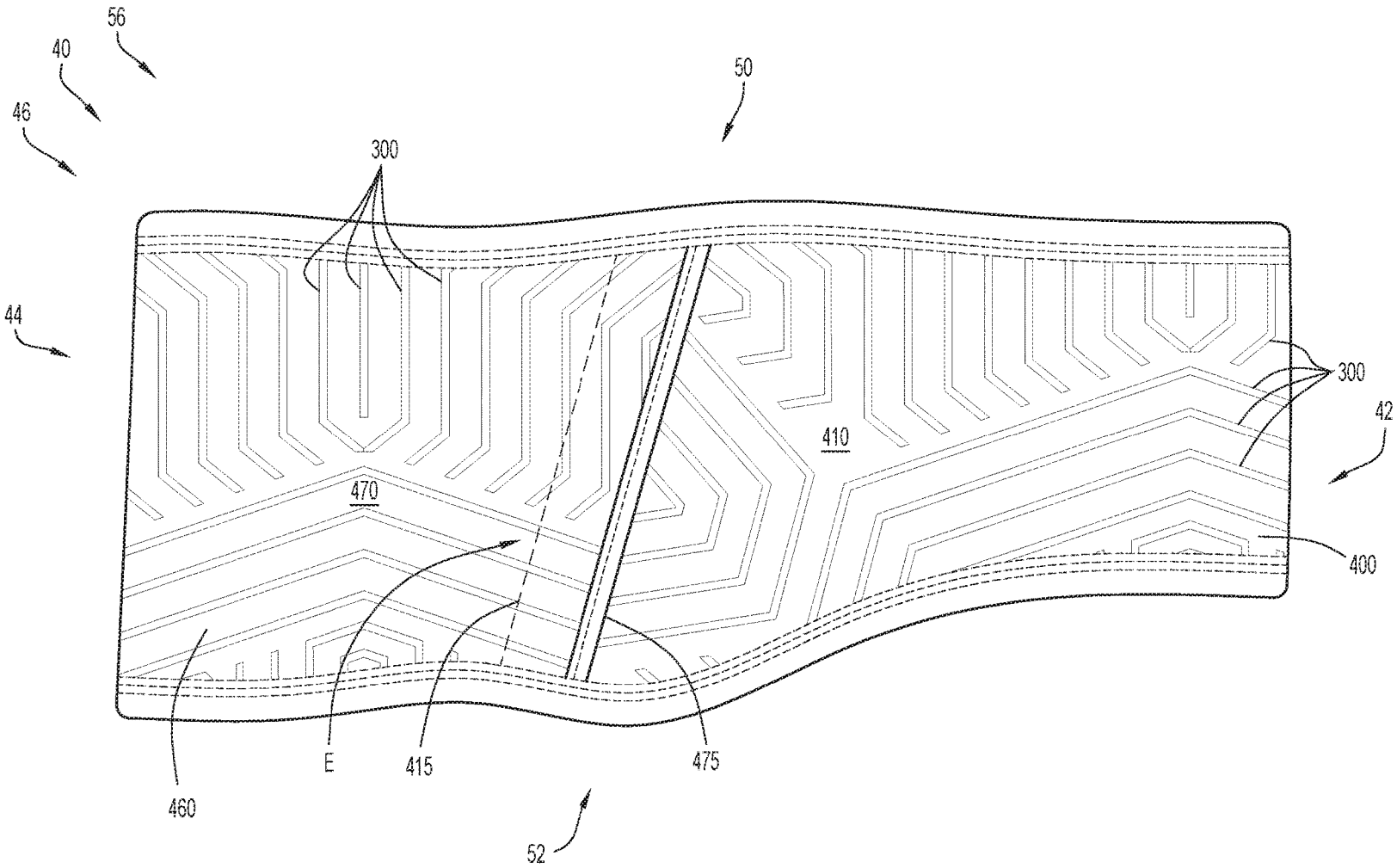
FIG. 9B illustrates a side elevational view of the interior surface of the first side of the headband illustrated in FIG. 7A, where the first pass-through opening is positioned in the closed position.

As best illustrated in FIGS. 9A and 9B, the first panel 400 is coupled to the second panel 460 such that the first terminal edge 415 of the first panel 400 is coupled to the first terminal edge 475 of the second panel 460 on the first side 46 of the headband 40. As best illustrated in FIG. 9A, on the exterior 54 of the headband 40, and proximate to the first side 46 of the headband 40, the first terminal edge 415 of the first panel 400 overlaps the first terminal edge 475 of the second panel 460 (shown as a phantom line in FIG. 9A). Conversely, as best illustrated in FIG. 9B, on the interior 56 of the headband 40, and also proximate to the first side 46 of the headband 40, the first terminal edge 475 of the second panel 460 overlaps the first terminal edge 415 of the first panel 400 (shown as a phantom line in FIG. 9B). FIGS. 9A and 9B illustrate the first terminal edge 415 of the first panel 400 and the first terminal edge 475 of the second panel 460 in the closed position E.

Figure 10A:
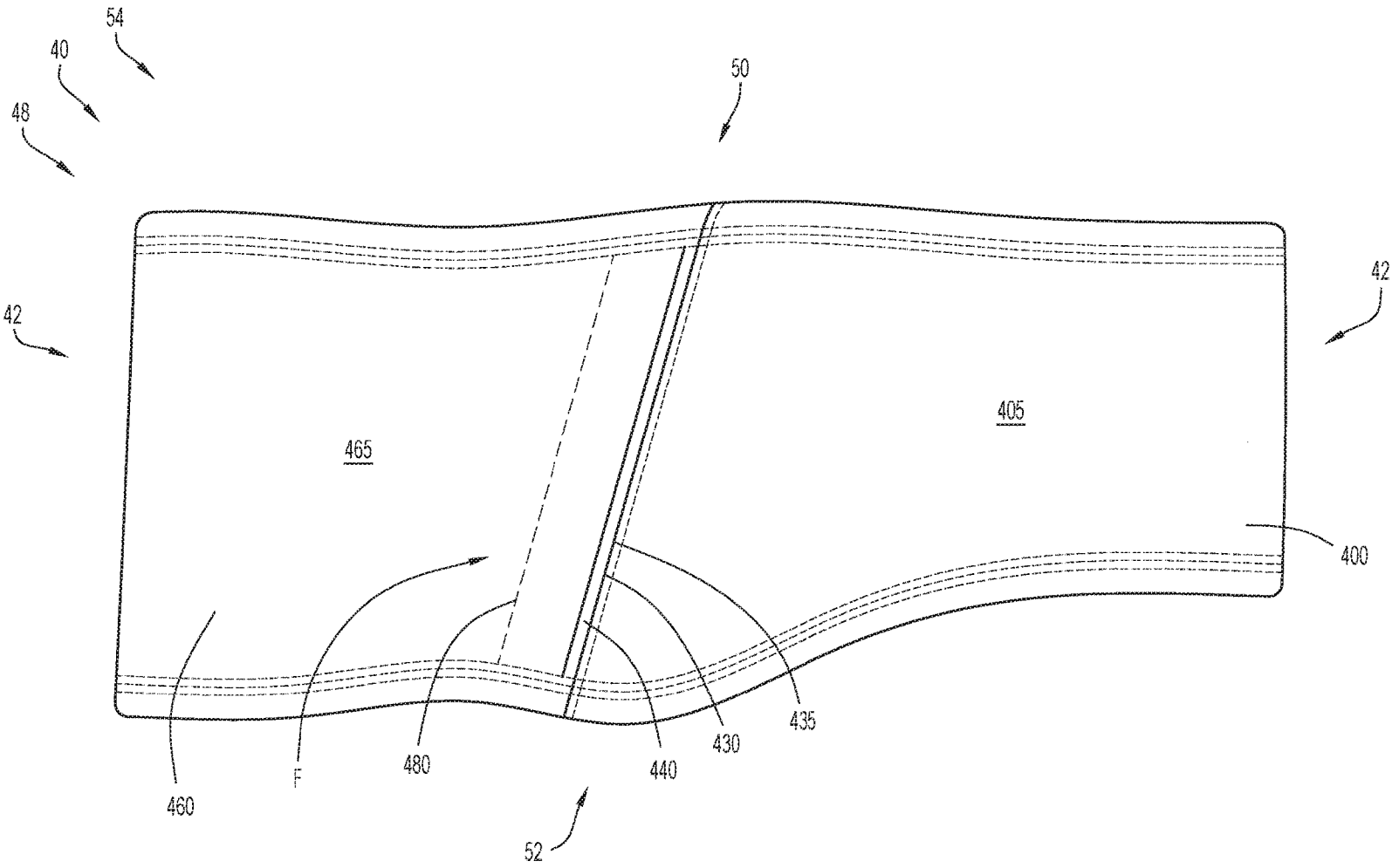
FIG. 10A illustrates a side elevational view of the exterior surface of second side of the embodiment of the headband illustrated FIG. 7A, where the second pass-through opening is positioned in the closed position.
Figure 10B:
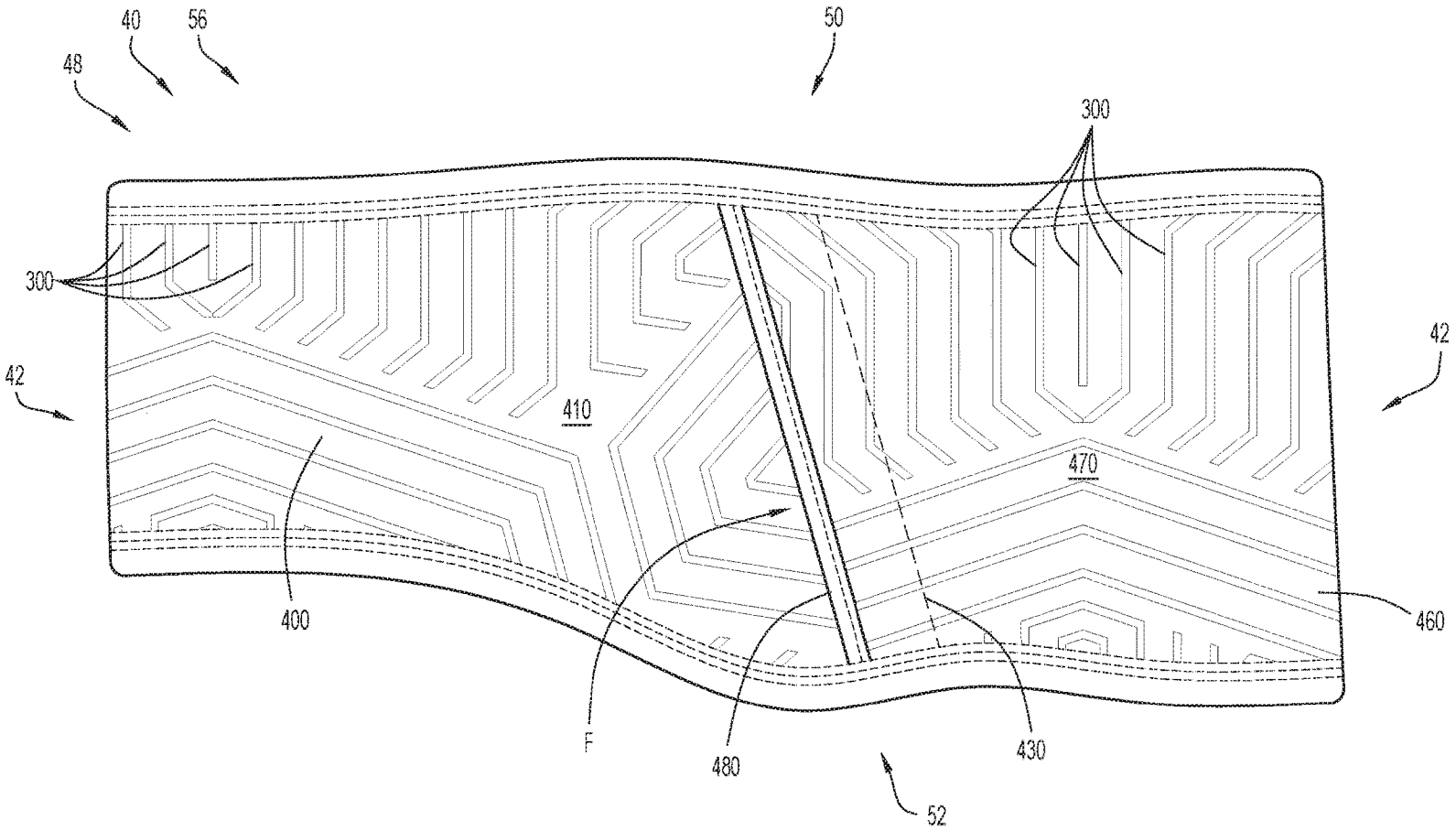
FIG. 10B illustrates a side elevational view of the interior surface of the second side of the embodiment of the headband illustrated FIG. 7A, where the second pass-through opening is positioned in the closed position.

Turning to FIGS. 10A and 10B, the first panel 400 is coupled to the second panel 460 such that the second terminal edge 430 of the first panel 400 is coupled to the second terminal edge 480 of the second couple 460 on the second side 48 of the headband 40. As best illustrated in FIG. 10A, on the exterior 54 of the headband 40, and proximate to the second side 48 of the headband 40, the second terminal edge 430 of the first panel 400 overlaps the second terminal edge 480 of the second panel 460 (shown as a phantom line in FIG. 10A). Conversely, as best illustrated in FIG. 10B, on the interior 56 of the headband 40, and also proximate to the second side 48 of the headband 40, the second terminal edge 480 of the second panel 460 overlaps the second terminal edge 430 of the first panel 400 (shown as a phantom line in FIG. 10B). FIGS. 10A and 10B illustrate the second terminal edge 430 of the first panel 400 and the second terminal edge 480 of the second panel 460 in the closed position F.

Figure 11A:
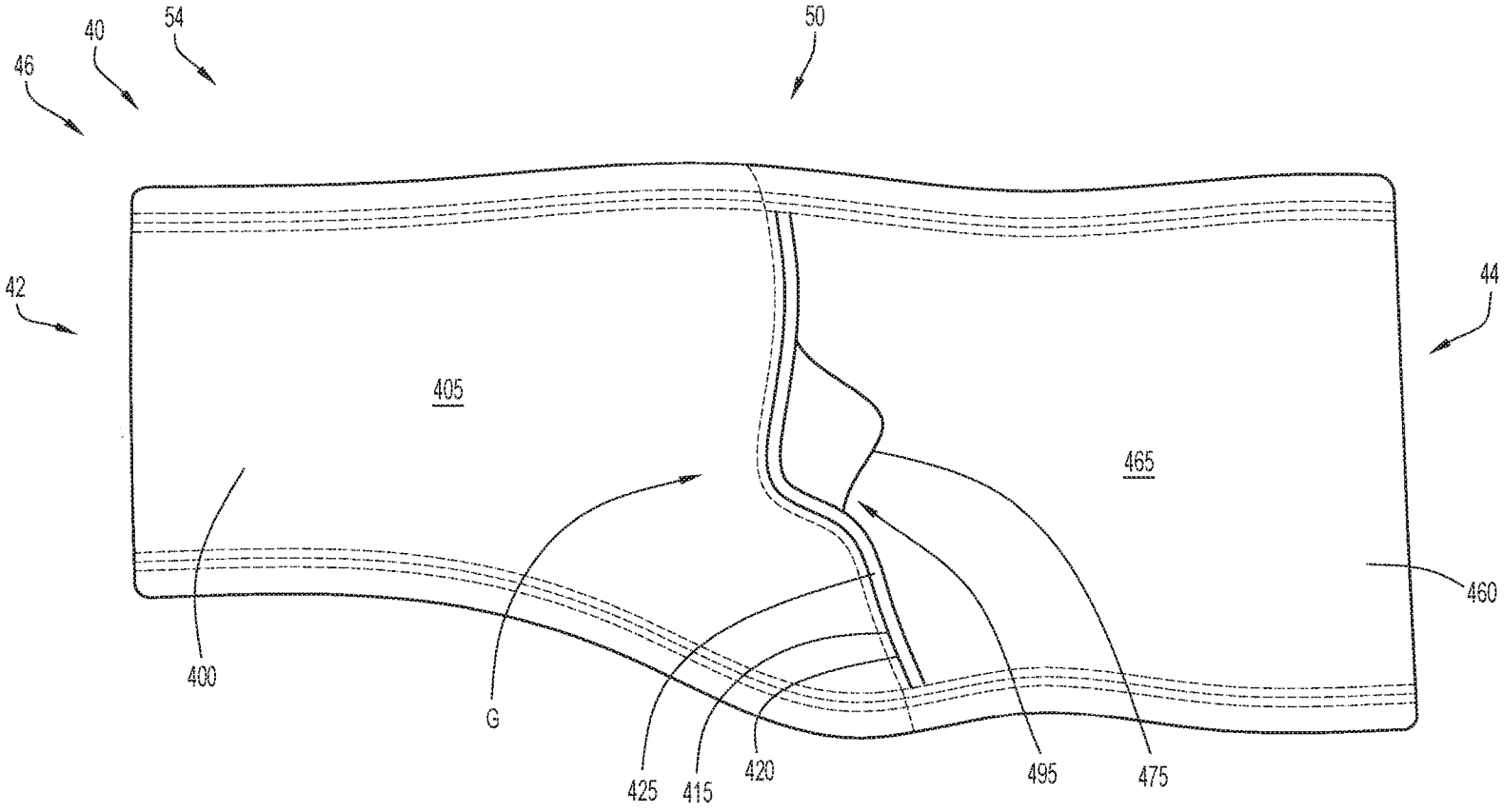
FIG. 11A illustrates a side elevational view of the exterior surface of the first side of the headband illustrated in FIG. 7A, where the first pass-through opening is positioned in the opened position.
Figure 11B:
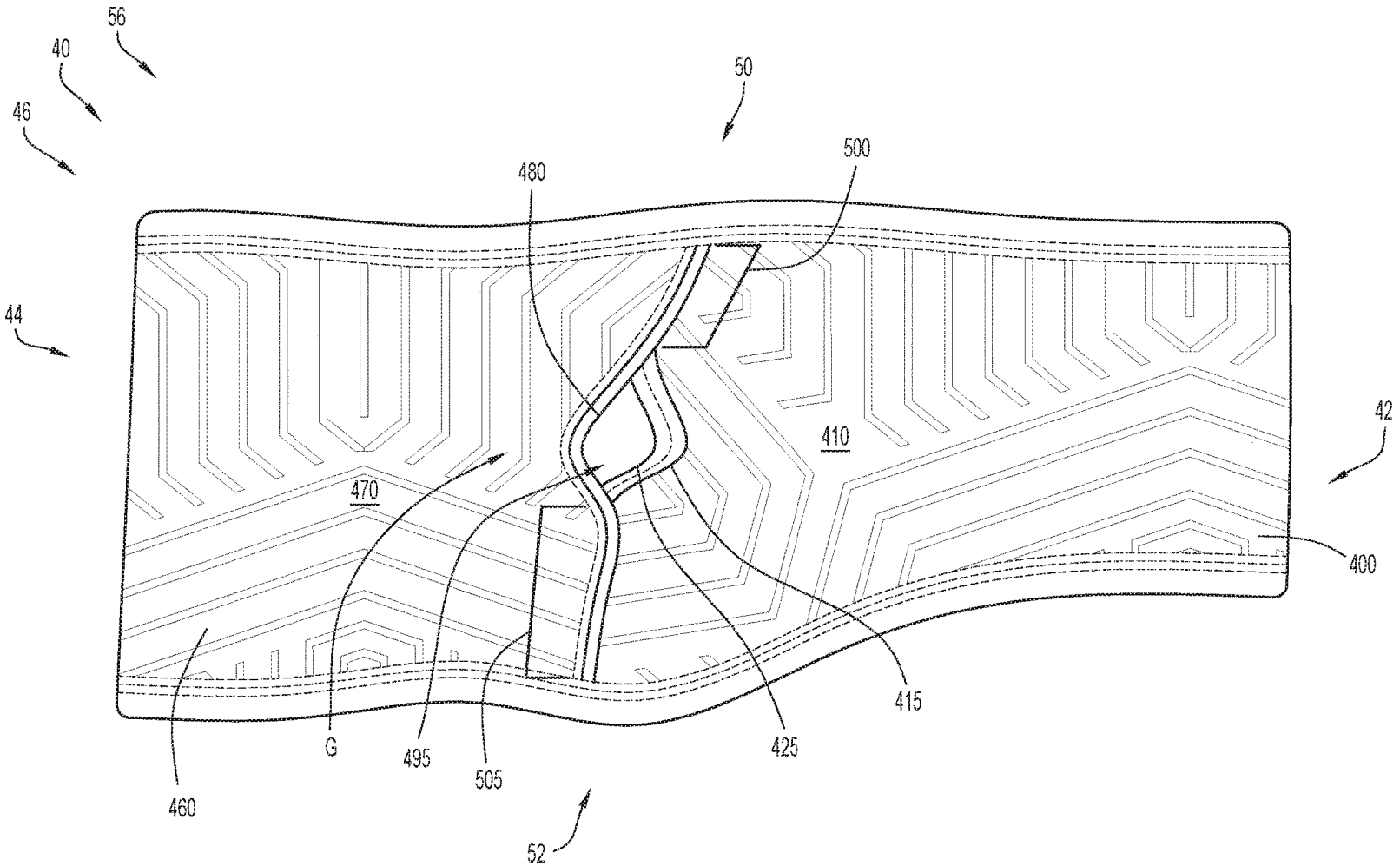
FIG. 11B illustrates a side elevational view of the interior surface of the first side of the headband illustrated in FIG. 7A, where the first pass-through opening is positioned in the opened position.

Turning to FIGS. 11A and 11B, illustrated is the positioning of the first terminal edge 415 of the first panel 400 in relation to the second terminal edge 475 of the second panel 460 when the terminal edges 415, 475 are in the opened position G. When in the opened position G, a portion of the first terminal edge 415 of the first panel 400 is separated from a portion of the first terminal edge 475 of the second panel 460 to create a first opening 495. The first opening 495 enables objects, such as earbuds, to be threaded through to the interior 56 of the headband 40. The first opening 495 must be large enough to receive objects, such as earbuds, but must be small enough to retain the earbuds in the opening, and thus the ear, when the user wearing the headband 40 is running or performing activities.

As best illustrated in FIGS. 11A and 11B, a portion of the first terminal edge 415 of the first panel 400 is folded towards the interior 56 of the headband 40 and over the interior surface 410 of the first panel 400 to form a first capped end 420 of the first panel 400. Coupled to the first capped end 420 is reflective piping 425. The reflective piping 425 may be coupled to the first capped end 420 by, but not limited to, stitching, bonding, adhesives, etc. As best illustrated in FIG. 11A, the reflective piping 425 extends beyond the first capped end 420. Similar to the reflective piping 155, 170 of the beanie hat 10, the reflective piping 425 may be constructed from a reflective material wrapped around a structure, such as foam, a pipe, a cord, etc. In addition, the reflective material of the reflective piping 425 may be configured to reflect light to provide additional visibility of the user wearing the headband 40 when light is shown in the direction of the user. The reflective material and/or the inner structure of the reflective piping 425 may be of a non-resilient material that eases manipulation of the first terminal edge 415 to separate the first terminal edge 415 of the first panel 400 a least partially from the first terminal edge 475 of the second panel 460. Thus, enabling the terminal edges 415, 475 to be reconfigured from the closed position E to the opened position G. By constructing the reflective piping 425 of a material with a contrasting texture from that of the material of the first and second panels 400, 460, the user of the headband 40 can more easily locate and separate the first terminal edge 415 of the first panel 400 from the first terminal edge 475 of the second panel 460 to thread objects through the first opening 495.

As further illustrated in FIG. 11B, the first terminal edge 415 of the first panel 400 may be coupled to the first terminal edge 475 of the second panel 460 via first upper stitching 500 and first lower stitching 505. The first upper stitching 500 may couple a portion or region of the first terminal edge 415 of the first panel 400 to a portion or region of the first terminal edge 475 of the second panel 460 proximate to the top edge 445 of the first panel 400 and the top edge 485 of the second panel 460. The first lower stitching 505 may couple a portion or region of the first terminal edge 415 of the first panel 400 to a portion or region of the first terminal edge 475 of the second panel 460 proximate to the bottom edge 450 of the first panel 400 and the bottom edge 490 of the second panel 460. The first upper and lower stitching 500, 505 may enable deformation and separation of the first terminal edge 415 of the first panel 400 from the first terminal edge 475 of the second panel 460 when a user pulls or manipulates the reflective piping 425 of the first terminal edge 415. Thus, the coupling of the first terminal edges 415, 475 by the first upper and first lower stitching 500, 505 causes the first terminal edge 475 of the second panel 460 to simultaneously move away from the first terminal edge 415 of the first panel 400 as the first terminal edge 415 is manipulated by the user wearing the headband 40. The movement of first terminal edge 475 of the second panel 460 away from the first terminal edge 415 of the first panel 400 creates the first opening 495.

Figure 12A:
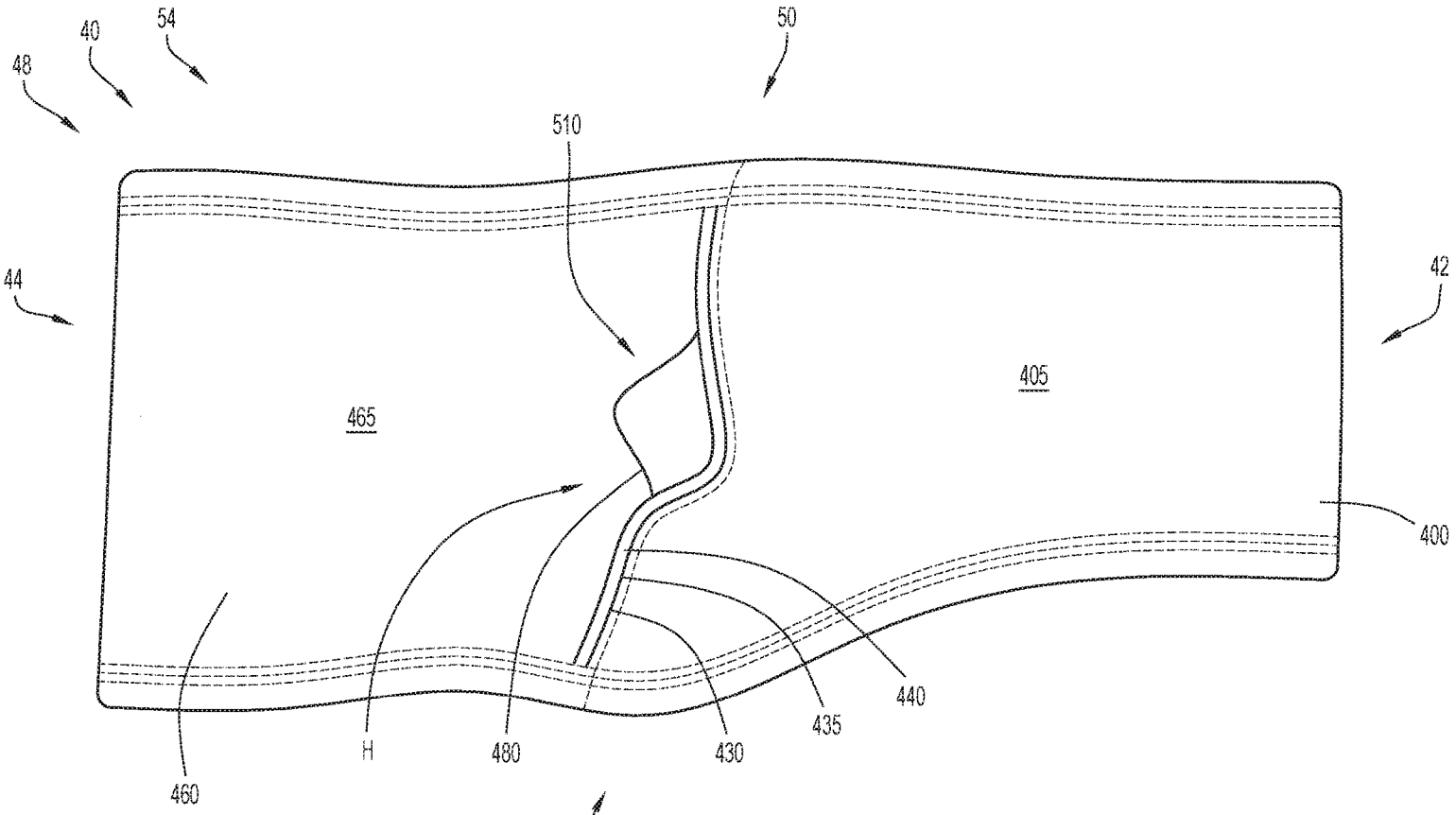
FIG. 12A illustrates a side elevational view of the exterior surface of the second side of the headband illustrated FIG. 7A, where the second pass-through opening is positioned in the opened position.
Figure 12B:
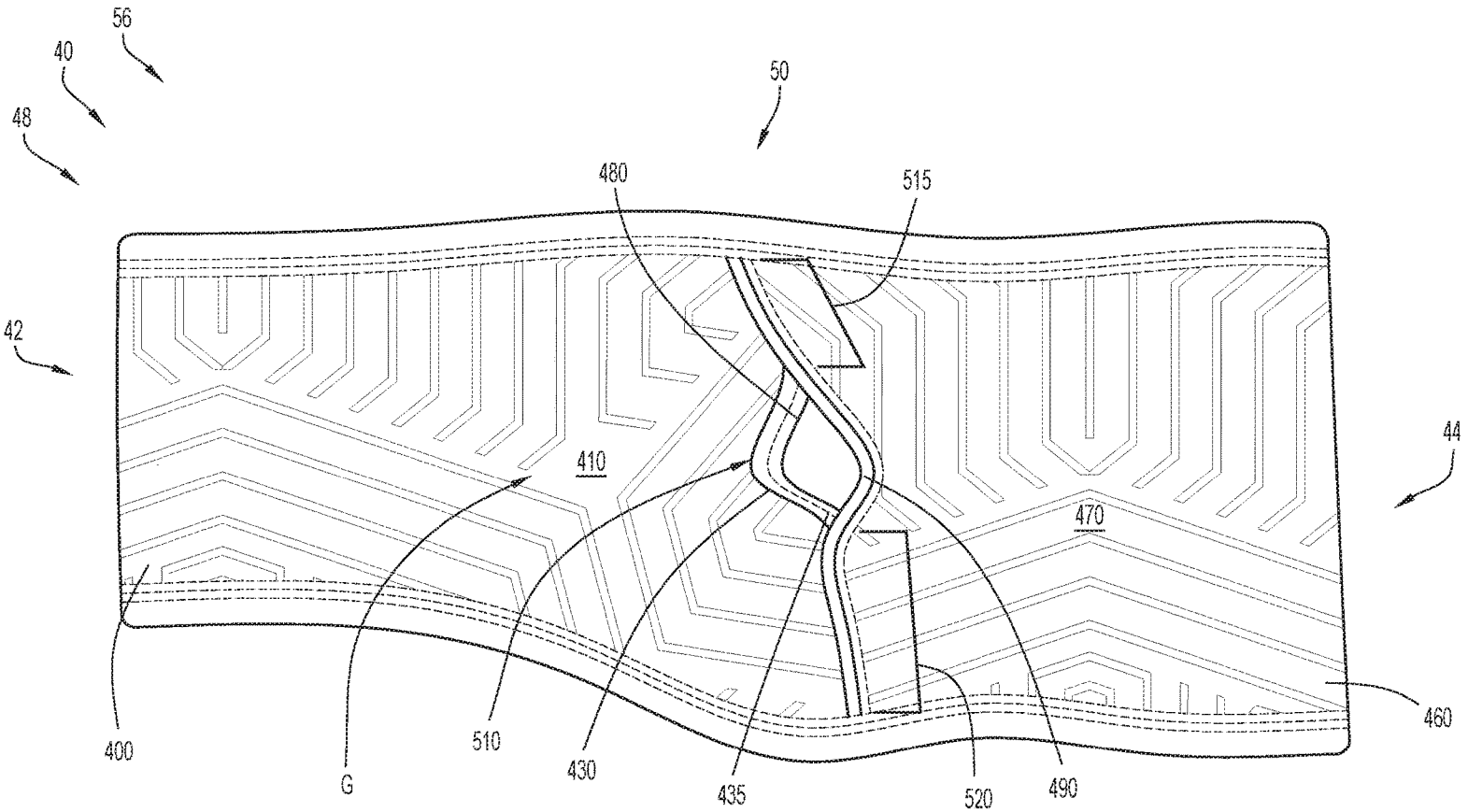
FIG. 12B illustrates a side elevational view of the interior surface of the second side of the embodiment of the headband illustrated FIG. 7A, where the second pass-through opening is positioned in the opened position.

Turning to FIGS. 12A and 12B, illustrated is the positioning of the second terminal edge 430 of the first panel 400 in relation to the second terminal edge 480 of the second panel 460 when the second terminal edges 430, 480 are in the opened position H. When in the opened position H, a portion of the second terminal edge 430 of the second panel 400 is separated from a portion of the second terminal edge 480 of the second panel 460. The at least partial separation of the second terminal edges 430, 480 creates a second opening 510. Similar to the first opening 495, the second opening 510 enables objects, such as earbuds, to be threaded through to the interior 56 of the headband 40. In addition, the second opening 510 must be large enough to receive objects, such as earbuds, but must be small enough to retain the earbuds within the opening, and thus the ear, when the user wearing the headband 40 is performing activities (e.g., running).

As best illustrated in FIG. 12B, a portion of the second terminal edge 430 of the first panel 400 is folded towards the interior 56 of the headband 40 and over the interior surface 410 of the first panel 400 to form a second capped end 435. Coupled to the second capped end 435 is reflective piping 440, which may be coupled via, but not limited to, stitching, bonding, adhesives, etc. As best illustrated in FIG. 12A, the reflective piping 440 extends beyond the second capped end 435. Similar to the reflective piping 425, the reflective piping 440 may be constructed from a reflective material wrapped around a structure, such as foam, a pipe, a cord, etc. The reflective material of the reflective piping 440 may be configured to reflect light to provide additional visibility of the user wearing the headband 40 when light is shown in the direction of the user. Furthermore, the reflective material and/or the inner structure of the reflective piping 440 may be of a non-resilient material that eases manipulation of the second terminal edge 430 in order to separate the second terminal edge 430 of the first panel 400 from the second terminal edge 480 of the second panel 460 when reconfiguring the second terminal edges 430, 480 from the closed position F to the opened position H. By constructing the reflective piping 440 of a material with a contrasting texture from that of the material of the first and second panels 400, 460, the user of the headband 40 can more easily locate and separate the second terminal edge 430 of the first panel 400 from the second terminal edge 480 of the second panel 460 to thread objects through the second opening 510.

As further illustrated in FIG. 12B, the second terminal edge 430 of the first panel 400 may be coupled to the second terminal edge 480 of the second panel 460 by second upper stitching 515 and second lower stitching 520. Second upper stitching 515 may couple a portion or region of the second terminal edge 430 of the first panel 400 to a portion or region of the second terminal edge 480 of the second panel 460 proximate to the top edge 445 of the first panel 400 and the top edge 485 of the second panel 460. The second lower stitching 520 may couple a portion or region of the second terminal edge 430 of the second panel 400 to a portion or region of the second terminal edge 480 of the second panel 460 proximate to the bottom edge 450 of the first panel 400 and the bottom edge 490 of the second panel 460. The second upper and lower stitching 515, 520 may enable deformation and separation of the second terminal edge 430 of the first panel 400 from the second terminal edge 480 of the second panel 460 when a user pulls on the reflective piping 440 of the second terminal edge 430. Thus, the coupling of the second terminal edges 430, 480 by the second upper and second lower stitching 515, 520 causes the second terminal edge 480 of the second panel 460 to simultaneously move away from the second terminal edge 430 of the first panel 400 as the second terminal edge 430 is manipulated by the user wearing the headband 40. The movement of the second terminal edge 480 of the second panel 460 away from the second terminal edge 430 of the first panel 400 creates the second opening 510.

Similar to the beanie hat 10, when the headband 40 is worn by a user, the overlap of the terminal edges 415, 430 of the first panel 400 with the terminal edges 475, 480 of the second panel 460 are positioned proximate to the ears of the user. Thus, when the headband 40 is worn by a user, the first and second openings 495, 510 are also positioned proximate to and over the ears of the user. It then follows that the first panel 400 may be disposed proximate to the forehead of the user, while the second panel 460 is disposed proximate to the back of the head of the user. As illustrated in FIGS. 9A and 10A, by having the first terminal edge 145 of the first panel 400 overlap the first terminal edge 475 of the second panel 460 on the exterior 54 of the headband 40, and by having the second terminal edge 430 of the first panel 400 overlap the second terminal edge 480 of the second panel 460 on the exterior 54 of the headband 40, the first and second openings 495, 510 open towards the rear side 44 of the headband 40. This causes the first and second openings 495, 510 to be rear facing, which enables earbuds threaded through the openings 495, 510 to remain in place in the ears of the user wearing the headband 40. Furthermore, by having the terminal edges 415, 430 of the first panel 400, which is disposed on the front side 42 of the headband 40, overlap the terminal edges 475, 480 of the second panel 460 located on the rear side 44 of the headband 40, wind and precipitation is prevented from entering the openings 495, 510 while the user wearing the headband 40 is performing activities (e.g., running, jogging, cycling, etc.).

Similar to the beanie hat 10, as illustrated in FIGS. 7B, 8B, 9B, 10B, 11B, and 12B, disposed on the interior surface 410 of the first panel 400 and the interior surface 470 of the second panel 460 of the headband 40 is a heat retaining coating 300. The heat retaining coating 300 may be disposed on the interior surfaces 410, 470 of the panels 400, 460 by, but not limited to, infusing the heat conducting coating 300 into the material of the panels 400, 460, bonding the heat retaining coating 300 to the interior surfaces 410, 470 of the panels 400, 460, or adhering the heat retaining coating 300 to the interior surfaces 410, 460 of the panels 400, 460. The heat retaining coating 300 may be configured to reflect some degree of heat radiated from the head of the user back onto the head of the user to further aid in keeping the covered portions of the head of the user warm. The head retaining coating 300 may be an aluminate ($AlO_2$), a zinc oxide (ZnO), a tin dioxide ($SnO_2$), a titanium dioxide ($TiO_2$), a silicon dioxide ($SiO_2$), a silicon carbide (SiC), a zirconium carbide (ZrC), or any combination thereof. Furthermore, as illustrated in FIGS. 7B, 8B, 9B, 10B, 11B, and 12B, the heat retaining coating 300 may be disposed on the interior surfaces the interior surfaces 410, 470 of the panels 400, 460 in striations or lines.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An article of headwear comprising:

a first fabric panel including a first edge disposed on a first side of the article of headwear and a second edge disposed on a second side the article of headwear, the second side being opposite the first side; and a second fabric panel coupled to the first fabric panel, the second fabric panel including a first edge and a second edge, wherein the first edge of the first fabric panel is coupled to the first edge of the second fabric panel and the second edge of the first fabric panel is coupled to the second edge of the second fabric panel, the first edge of the first fabric panel and the first edge of the second fabric panel forming a first opening on the first side of the article of headwear, and the second edge of the first fabric panel and the second edge of the second fabric panel forming a second opening on the second side of the article of headwear, and wherein, when the article of headwear is worn by a user, the first opening is configured to be disposed over a first ear of the user and the second opening is configure to be disposed over a second ear of the user.

2. The article of headwear of claim 1, wherein the first edge of the first fabric panel at least partially overlays the first edge of the second fabric panel, and the second edge of the first fabric panel at least partially overlays the second edge of the second fabric panel.

3. The article of headwear of claim 2, wherein the first fabric panel includes an exterior surface and an interior surface, and the second fabric panel includes an exterior surface and an interior surface, and the headwear is reconfigurable between a first configuration and a second configuration, wherein the first configuration comprises the interior surface of a portion of the first fabric panel proximate to the first and second edges of the first fabric panel being disposed adjacent the exterior surface of a portion of the second fabric panel proximate to the first and second edges of the second fabric panel, and the second configuration comprises the portion of the interior surface of the first fabric panel being distanced from the exterior surface of the second fabric panel.

4. The article of headwear of claim 2, wherein a heat retaining material is disposed on one or more interior surface portions of the first fabric panel and the second fabric panel.

5. The article of headwear of claim 1, further comprising a non-resilient reflective material is coupled to least the first edge and the second edge of the first fabric panel.

6. The article of headwear of claim 1, wherein the first fabric panel and the second fabric panel are constructed from a resilient material.

7. An article of headwear comprising:

a sheet of fabric forming a first side of the article of headwear, a second side of the article of headwear that is disposed opposite the first side, an exterior surface of the article of headwear, and an interior surface of the article of headwear;

a first opening disposed in the sheet of fabric proximate to the first side of the article of headwear, the first opening defined by a first edge and a second edge, where the first edge overlaps the second edge; and a second opening disposed in the sheet of fabric proximate to the second side of the article of headwear, the second opening defined by a third edge and a fourth edge, where the third edge overlaps the fourth edge, wherein, when the article of headwear is worn by a user, the first opening is configure to be disposed over a first ear of the user and the second opening is configure to be disposed over a second ear of the user.

8. The article of headwear of claim 7, wherein the sheet of fabric is constructed from a resilient material.

9. The article of headwear of claim 7, wherein the sheet of fabric is constructed of a plurality of fabric panels.

10. The article of headwear of claim 7, wherein the first opening has a closed position, where the first edge overlaps the second edge, and an open position, where a portion of the first edge is distanced from the second edge.

11. The article of headwear of claim 7, wherein the second opening has a closed position, where the third edge overlaps the fourth edge, and an open position, where a portion of the third edge is distanced from the fourth edge.

12. The article of headwear of claim7, wherein a heat retaining material is disposed on interior surfaces of the first fabric panel and the second fabric panel.

13. The article of headwear of claim 7, further comprising a non-resilient reflective material coupled to least the first edge and the third edge.

14. An article of headwear comprising:

a first fabric panel including an exterior surface, an interior surface, a first edge disposed on a first side of the article of headwear, and a second edge disposed on a second side of the article of headwear, the second side being opposite the first side; and a second fabric including an exterior surface, an interior surface, a first edge disposed on the first side of the article of headwear, and a second edge disposed on the second side of the article of headwear, the second fabric panel being coupled to the first fabric panel, wherein the first edge of the first fabric panel overlays the first edge of the second fabric panel on the exterior surface of the second fabric panel and the second edge of the first fabric panel overlays the second edge of the second fabric panel on the exterior surface of the second fabric panel, wherein the first edge of the first fabric panel and the first edge of the second fabric panel form a first opening disposed on the first side of the article of headwear, and the second edge of the first fabric panel and the second edge of the second fabric panel form a second opening disposed on the second side of the article of headwear, and wherein, when the article of headwear is worn by a user, the first opening is configure to be disposed over a first ear of the user and the second opening is configure to be disposed over a second ear of the user.

15. The article of headwear of claim 14, wherein the headwear is reconfigurable between a first configuration, where the first and second openings are closed, and a second configuration, where the first and second openings are open.

16. The article of headwear of claim 15, wherein, in the first configuration, an interior surface portion of the first fabric panel proximate to the first and second edges of the first fabric panel is adjacent an exterior surface portion of the second fabric panel proximate to the first and second edges of the second fabric panel.

17. The article of headwear of claim 16, wherein, in the second configuration, the interior surface portion of the first fabric panel is distanced from the exterior surface portion of the second fabric panel.

18. The article of headwear of claim 14, wherein a heat retaining material is disposed on one or more interior surface portions of the first fabric panel and the second fabric panel.

19. The article of headwear of claim 14, further comprising a non-resilient reflective material coupled to least the first edge and the second edge of the first fabric panel.

* * * * *